US008528281B2

(12) United States Patent
Boldt

(10) Patent No.: US 8,528,281 B2
(45) Date of Patent: Sep. 10, 2013

(54) WINDOW AND DOOR ASSEMBLY STRUCTURES

(75) Inventor: Gary L. Boldt, Green Bay, WI (US)

(73) Assignee: Bay Industries Inc., Green Bay, WI (US)

( * ) Notice: Subject to any disclaimer, the term of this patent is extended or adjusted under 35 U.S.C. 154(b) by 733 days.

(21) Appl. No.: 12/590,374

(22) Filed: Nov. 6, 2009

(65) Prior Publication Data

US 2011/0107695 A1 May 12, 2011

(51) Int. Cl.

| | |
|---|---|
| ***E06B 1/04*** | (2006.01) |
| ***E04C 2/38*** | (2006.01) |
| ***E04B 1/00*** | (2006.01) |
| ***E04G 21/00*** | (2006.01) |

(52) U.S. Cl.
USPC ..... 52/211; 52/212; 52/656.4; 52/656.5; 52/717.01; 52/745.15

(58) Field of Classification Search
USPC ..... 52/97, 204.1, 204.2, 210, 211, 212, 52/204.5, 656.1, 656.2, 656.7, 656.4, 656.5, 52/656.6, 717.01, 745.15, 745.16
See application file for complete search history.

(56) References Cited

U.S. PATENT DOCUMENTS

| | | | | |
|---|---|---|---|---|
| 3,690,082 | A | 9/1972 | Byland | |
| 4,505,080 | A * | 3/1985 | Sailor | 52/211 |
| 4,924,631 | A | 5/1990 | Davies et al. | |
| 5,058,323 | A | 10/1991 | Gerritsen | |
| 5,070,651 | A | 12/1991 | Jeter | |
| 5,199,234 | A | 4/1993 | Guhl | |
| 5,435,106 | A * | 7/1995 | Garries et al. | 52/204.5 |
| 5,699,637 | A * | 12/1997 | Marocco | 52/204.53 |
| 5,722,207 | A | 3/1998 | Anderson et al. | |
| 5,735,035 | A * | 4/1998 | Holt | 29/527.2 |
| 5,758,458 | A * | 6/1998 | Ridge | 52/204.1 |
| 6,125,605 | A * | 10/2000 | Young | 52/717.01 |
| 6,161,344 | A * | 12/2000 | Blanchett | 52/97 |
| 6,223,484 | B1 | 5/2001 | Minter | |
| 6,343,438 | B1 | 2/2002 | Boldt | |
| 6,526,709 | B1 * | 3/2003 | Jacobsen | 52/211 |
| 6,568,137 | B2 * | 5/2003 | Ballantyne | 52/211 |

(Continued)

OTHER PUBLICATIONS

Wausau Supply Company, Clad System Components, what appears to be a catalog page from Wausau Supply Company received from Dusty Dvorak, 1 page.

(Continued)

*Primary Examiner* — Ryan Kwiecinski
(74) *Attorney, Agent, or Firm* — Thomas D. Wilhelm; Wilhelm Law, S.C.

(57) ABSTRACT

A nosing and drip cap are mounted to each other by elements of the nosing and drip cap. A hook receptacle and/or a stud receptacle extend the length of the nosing. A cooperating hook and/or stud extend from the drip cap. The drip cap is secured to the nosing by engaging the hook in the hook receptacle and/or the stud in the stud receptacle, in a loose engagement combination. While nosing and drip cap are engaged, the assembly can be secured together by (i) installing fasteners spaced along the length of the assembly or, where hook and hook receptacle are used, (ii) bending the assembly into an arcuate configuration, with the inner flange of the nosing to the inside of the bend. While being bent, the hook and hook receptacle create a tightened locking-type engagement between themselves. Either way, the nosing and the drip cap are substantially permanently locked together.

30 Claims, 12 Drawing Sheets

(56) References Cited

U.S. PATENT DOCUMENTS

| | | | | |
|---|---|---|---|---|
| 6,604,334 | B2 * | 8/2003 | Rochman | 52/717.01 |
| 6,631,595 | B1 * | 10/2003 | Minter | 52/212 |
| 6,745,523 | B2 | 6/2004 | Petta | |
| 7,043,883 | B1 * | 5/2006 | Cederberg et al. | 52/204.1 |
| 7,111,433 | B2 * | 9/2006 | Kerscher | 52/212 |
| 7,284,353 | B2 * | 10/2007 | Bealko | 52/656.5 |
| 7,712,262 | B2 * | 5/2010 | Scanlan | 52/86 |
| 2002/0078640 | A1 * | 6/2002 | Petta | 52/204.1 |
| 2003/0145538 | A1 * | 8/2003 | Kerscher | 52/212 |
| 2004/0211132 | A1 * | 10/2004 | Petta et al. | 52/204.1 |
| 2005/0097838 | A1 * | 5/2005 | Kerscher | 52/204.1 |
| 2007/0074469 | A1 * | 4/2007 | Plagemann et al. | 52/204.1 |
| 2007/0137117 | A1 * | 6/2007 | Carlson et al. | 52/204.1 |
| 2007/0245649 | A1 * | 10/2007 | Habeck et al. | 52/212 |
| 2008/0072506 | A1 * | 3/2008 | LeGoff | 52/204.1 |
| 2008/0172956 | A1 * | 7/2008 | Boldt et al. | 52/204.1 |
| 2008/0172957 | A1 * | 7/2008 | Kerscher | 52/204.1 |
| 2010/0269432 | A1 * | 10/2010 | Furgerson et al. | 52/213 |

OTHER PUBLICATIONS

Tecton Products LLC, Tecton Door System A Door Is Only As Good As Its Frame, Product Literature, Believed to be first published in 2005, 3 pages.

Tecton Products LLC, Products Tecton Door System, www.tectonproducts.com/, Printed Mar. 27, 2006, 11 pages.

Frontline Bldg. Products, Clad Overhead Door Frames, Brochure, Copyrighted 1996, 2 pages.

Frontline Bldg. Products, Clad Entry Door Systems, Brochure, Copyrighted 1996, 2 pages.

Frontline Bldg. Products, Aluminum Clad Garage Door Frame, Copyrighted 1998, 2 pages.

Frontline Bldg. Products, New for 1998 . . . Frontline "Classic Clad System", Undated, 1 page.

Frontline Bldg. Products, Cladding Solutions for Every Situation, Undated, 2 pages.

Frontline Bldg. Products, Classic Clad System, Undated, 2 pages.

Bay Industries, FLB-38B and FLB-56, Nosing having two mounting fin kerfs, assembled with mounting fin, drawings, undated, 1 page.

Frontline Bldg. Products, New Frontline Cladding System, Undated, 1 page.

* cited by examiner

WINDOW AND DOOR ASSEMBLY STRUCTURES

BACKGROUND OF THE INVENTION

This invention relates in general to clad windows and clad personnel entry doors. This invention relates especially to clad door frames which are used in buildings as avenues for people entering and exiting the building, including door assemblies wherein windows are joined to such door frames either as side lites or as overhead transom windows. This invention also relates to overlying clad transom windows used in clad door assemblies. The invention further relates to joining clad window frames to each other, to joining clad door frames to each other, and to joining clad window frames and clad door frames to each other.

Arcuate windows, overlying e.g. a rectangular window, or overlying a door, have achieved an established position in the market for windows and doors. Arcuate windows can provide a desired aesthetic/artistic characteristic to the overall appearance of a building.

Penetration of water into window frames is known as a significant source of deterioration/damage in window frames which use wood as a structural and/or decorative material.

Advances have been made in the fabrication of the arcuate portions of window framing from wood, and in the fabrication of glazing units from glass or other sheet material, for such windows. The nosing portion of the cladding which attaches to the structural window framing is desirably made of a material which is more weather-resistant than wood in order to avoid frequent maintenance to the outside surface of the window structure and to reduce the amount of water which penetrates the window, thereby reaching the wood substrate and causing deterioration of the wood substrate.

Doors and windows are generally assembled by an assembler. The assembler incorporates the respective door slab in a door frame and the respective window glazing in a window frame. As desired, window clusters may be assembled in a single window frame which extends about the outer perimeter of the cluster, and side light windows may be assembled to a door frame.

A window which is located directly over a door or door/sidelight combination is commonly referred to as a transom window. Transom windows are desirably assembled into a common unit with the respective underlying door frame so that the combined structure can be inserted, as a single unit, into the rough opening in the building.

However, the industry has not to date provided adequate interface structure which facilitates easily joining the transom window frame to an underlying door frame during assembly of the transom window to the underlying door frame.

Ongoing advances in development of window and door frames have moved toward extruded aluminum and extruded plastics as materials of choice to face the ambient environment on the outside surface of the building. Extruded aluminum and extruded plastics require only limited maintenance.

Transom windows, and windows in general, are conventionally fabricated in a wide variety of shapes. In some windows, all of the sides are straight. In other windows, some of the sides are arcuate or otherwise curvilinear as in conventional half-round and eyebrow windows. So, while it would be desirable to provide similarly-configured nosings and drip caps, extruded aluminum and extruded plastics, from which nosings and drip caps are commonly made, are typically fabricated in extended production runs as straight-line extrusions, whereby arcuate extrusions of such structures are not available as mass produced articles of commerce.

In some instances, it is desirable to attach an arcuate drip cap to an arcuate nosing, or to an arcuate portion of a nosing. In response to the desire for arcuate nosing material for arcuate windows, the industry has developed the technical capability to bend conventionally-fabricated straight-line rectangular nosing extrusions, without drip caps.

Thus, the industry offers an aluminum nosing which is extruded as a straight nosing. After being extruded as an elongate straight profile nosing, the aluminum nosing is bent to the desired arcuate configuration. In order to have an arcuate drip cap which can be used with such bent/arcuate nosing, a straight, extruded drip cap is separately bent into the desired arcuate shape. The lower surface of the platform of the so-bent drip cap is then positioned over the outer surface of the outer flange of the so-bent nosing, with the inner end of the drip cap in general alignment with the inner-facing web of the nosing. In conventional assemblies, there is no alignment structure in the drip cap or in the nosing which assists in holding the drip cap in alignment over the nosing, or which assists in mounting the drip cap to the nosing. Rather, the assembler places the drip cap on the nosing, and holds the drip cap in "X" and "Y" alignment with the nosing, while attaching the arcuately-formed drip cap to the arcuately-formed nosing, using screws spaced generally uniformly along the full length of the drip cap.

The first function of the screws is to attach the drip cap to the nosing. The second function of the screws is to maintain the alignment between the drip cap and the nosing. In addition, as the screws are tightened, the tightening of the screws acts to force the arcuate configuration of the drip cap and the arcuate configuration of the nosing to conform to each other whereby any variations in the angle or consistency of the arc radii of the drip cap and the nosing are desirably nullified as the drip cap and the nosing are drawn together by the tightening of the screws. In the event of a substantial misalignment of nosing and drip cap, or substantially different subtended arcs, extra tightening force may be used on the screws, along with corrective lateral alignment forces between the nosing and the drip cap, within the limits allowed by the screw holes, to attempt to conform the drip cap and nosing to each other. If too much force is used tightening a screw, the threads may be stripped, either on the screw or on the drip cap or on the nosing. If a user encounters excessive difficulty in assembling an assembly, including potential damage to the nosing or the drip cap, the drip cap or the nosing may be discarded in favor of a different piece, drip cap or nosing, which will, hopefully, be better suited for the desired assembly configuration, or will not be damaged during the assembly process. Even where the nosing and the drip cap are properly configured in terms of cooperative arcuate radii, and where the assembler does not strip any threads, the assembly of the two elements together, and their alignment, are completely dependent on use of acceptable gripping power, and structural integrity, relative to the assembly screws, which are maintained under constant stress. The stress on the screws in the assembly represents a combination of the tension normally needed to hold assembled parts in surface-to-surface contact with each other where both parts are in fact formed to the same arcuate configuration, as well as the tension needed to bend either the nosing or the drip cap, potentially along the full lengths of those parts, in order to correct inconsistencies in the arcuate configurations of the parts being assembled.

Further, the screws present a less-than-desirable appearance to the window framing. The screws tend to catch dirt; and the screws provide potential avenues for water to leak into the window structure. Further, the screws incur a certain labor cost while assembling the assembly. Overall, the screws are attended by a number of negative factors whereby it is desirable to reduce the number of screws which need to be used at locations where the screws are exposed to casual visual observation or where the screws are exposed to ambient weather.

In addition, the assembly process bears a certain risk of misalignment of the drip cap on the nosing. Namely, the worker who is assembling the drip cap to the nosing must ensure that the drip cap remains aligned with the nosing throughout the assembly process, until all of the screws are in place.

For conventional joining of clad window frames to clad door frames, or clad window frames to clad window frames, or clad door frames to clad door frames, the respective frames are typically aligned with each other with the assistance of a jig or other fixture which is not part of either frame. The frames are then secured to each other using fasteners such as screws or nails. A mullion cap or the like is then driven into the molding/nosing kerf receptacles thereby to cover the joint between the frames. Such mullion cap is employed for aesthetic/appearance purposes, and does not contribute significantly to the function of holding the frames secured together. Rather, the securement function is performed by the e.g. screws or nails or other fasteners external of the nosings.

SUMMARY

Thus, it is desirable to provide a nosing assembly which has minimum maintenance requirements and which is less susceptible to penetration by air-borne water from the ambient environment.

It is still further desirable to provide a nosing assembly wherein relatively lower levels of attention can be exerted toward holding the respective elements in the desired alignment during the assembly process.

It is yet further desirable to provide such nosing assembly wherein at least a portion of the nosing assembly has been fabricated into an arcuate configuration.

It is yet further desirable to provide an arcuate nosing assembly wherein the elements being assembled generally fit together in such a way that, in the loose assemblage of the nosing and drip cap to each other, the nosing and the drip cap assist in self-aligning themselves with respect to each other.

It is also desirable to provide a method of fabricating an arcuate nosing assembly wherein the assembly method so re-forms the nosing and the drip cap that the re-formed nosing and drip cap, themselves, provide the primary structures which hold the respective elements in fixed relationship with respect to each other.

It is yet further desirable to provide a method of fabricating an arcuate nosing assembly wherein the assembly method comprises positioning the nosing and the drip cap generally in the desired assembly configuration, and then bending the combination of the nosing and the drip cap, with the drip cap to the outside of the bent configuration, the bending of the drip cap and the nosing operating to bind the nosing and the drip cap to each other.

It is further desirable to provide a combination of first and second nosings wherein the nosings are adapted to being at least temporarily assembled to each other using only elements of the nosings to hold the elements of the nosings in such joinder.

It is yet further desirable to provide a combination of first and second nosings wherein structure on the nosings causes the sliding assembling of the nosings into each other to stop when the assembly process reaches the point where the outer-facing webs on the respective nosings define a generally common surface.

It is also desirable that the insert on each of the first and second nosings be assembled into a receptacle on the corresponding other nosing.

It is further desirable to employ clad door frames using nosings of the invention.

It is yet further desirable to provide clad window frames, or clad door/window combinations, using nosings of the invention.

It is still further desirable to provide clad door frames which employ the invention in combination with clad window frames in a single assembly unit.

It is still further desirable to provide clad door frame combinations which employ the invention.

In some embodiments, the invention relates to clad arcuate windows, especially clad arcuate windows which are used in transom configurations overlying a clad window frame or overlying a clad door frame. The invention relates to improved nosing structure for use about the arcuate portion of a clad arcuate transom window, and to improved nosing structure for joining respective window units to each other, for joining respective door units to each other, and for joining clad window units to clad door units.

The invention relates to the interface between a first clad window frame and a second clad window frame, or to the interface between a clad window frame and a clad door frame, or to the interface between a first clad door frame and a second clad door frame.

In general, a clad window includes a glazing unit, held in a structural clad window frame and a clad door includes a door slab held in a structural clad door frame.

A decorative nosing is commonly included at, or added to, the exterior face of the respective clad door frame or clad window frame, which exterior face will face away from the building, generally to provide both exterior aesthetics and to protect the main body of the frame from direct exposure to the weathering/deterioration affects caused by the ambient environment.

In some embodiments of the invention, a combination of an arcuate nosing, and an arcuate drip cap overlying the nosing, are secured together by collective interaction of elements of the nosing and the drip cap. An elongate hook receptacle extends along the length of the nosing, proximate or at an outer flange. An elongate stud receptacle extends along the length of the nosing, also proximate or at the outer flange. Both an elongate hook and an elongate stud extend downwardly from the overlying elongate drip cap. Securement of the drip cap to the nosing is obtained by inter-engaging the elongate hook in the hook receptacle and aligning the stud with the stud receptacle, in a loose engagement combination of straight extruded-aluminum elongate profiles of the respective precursor nosing and precursor drip cap. While the drip cap and nosing are so engaged with each other, the temporary assemblage of the nosing and the drip cap is bent into the desired arcuate configuration, with the inner flange of the nosing being to the inside of the bend, thereby re-forming the combination of the nosing and the drip cap. In the process of bending, reforming the nosing/drip cap combination, to create the desired arcuate nosing assembly configuration, the inter-engaged hook and hook receptacle are re-formed, optionally referred to as "cold-forming", creating a tightened locking-type engagement between the hook and the hook receptacle. The result is that the nosing and the drip cap are substantially permanently locked to each other as a consequence of the process of bending the assembled nosing/drip cap combination.

In other embodiments of the invention, a nosing, and a drip cap overlying the nosing, are positioned relative to each other by collective interaction of elements of the nosing and the drip cap. An elongate stud receptacle extends along the length of the nosing, proximate or in an outer flange. An elongate stud extends downwardly from the overlying elongate drip cap. Positioning of the drip cap relative to the nosing is obtained by aligning the stud with the stud receptacle, in a loose engagement combination of straight extruded-aluminum elongate profiles of the respective precursor nosing and precursor drip cap. While the drip cap and nosing are so engaged with each other, screw holes are fabricated through the drip cap, and through an outer panel of the nosing. The drip cap is then secured to the nosing using screws extending through the respective holes. The result is that the nosing and the drip cap are substantially permanently secured to each other by the so-employed screws, where the nosing and drip cap are oriented in a straight-line configuration.

In a first family of embodiments, the invention comprehends a combination of an elongate nosing and an elongate drip cap. The elongate nosing has a nosing length, and comprises an elongate inner flange having a first outer end and a second inner end, an elongate outer flange having an outer surface, an outer flange length, a third outer end, and a fourth inner end, the outer flange being spaced from the inner flange, an elongate outer-facing web having an outer-facing web length, the outer-facing web connecting to the first end of the inner flange and the third end of the outer flange, an elongate inner-facing web, the inner-facing web connecting to the second end of the inner flange and to the fourth end of the outer flange, an elongate front facia flange, the front facia flange extending away from the outer flange, and being displaced from the outer-facing web, and at least one of a stud receptacle having an opening extending from the outer surface of the outer flange toward the inner flange, and a hook receptacle having an opening and extending from the opening at one of the outer flange, the outer-facing web, and the inner-facing web, into the nosing and toward one of the outer-facing web and the inner-facing web; and the elongate drip cap being adapted to being mounted to the nosing, the drip cap having opposing ends and a drip cap length, and comprising an elongate drip cap platform, having a first inner side and a second outer side, a platform upper surface, and a platform lower surface, and at least one of a stud and a hook extending downwardly from the platform and being adapted to cooperate with a respective one of the stud receptacle and the hook receptacle in assembling the drip cap and the nosing to each other.

In some embodiments, the inner side of the platform is in alignment with the inner-facing web when the drip cap is assembled to the nosing.

In some embodiments, the nosing comprises a hook receptacle, and the drip cap further comprises a hook extending downwardly from the platform, and toward one of the first inner side of the platform and the second outer side of the platform.

In some embodiments, the drip cap further comprises a stud located, from the hook, toward the first inner side of the platform.

In some embodiments, the elongate drip cap further comprises an elongate drip flange extending from the platform, at the second outer side of the platform, in a direction away from the first inner side of the platform.

In some embodiments, the nosing and the drip cap are extruded aluminum profiles, and at least portions of the lengths of the nosing and the drip cap are arranged in arcuate configurations and the front facia flange is disposed to the inside of the arc in the nosing.

In some embodiments, the invention comprehends an arcuate nosing assembly wherein the drip cap and the nosing are assembled to each other with the hook in the hook receptacle, the nosing assembly having been bent about a radius of at least 6 inches, into the arcuate configuration, and the hook and the hook receptacle have been brought into a locking-type engagement with each other.

In some embodiments, the nosing assembly further comprises an elongate intermediate web extending between intermediate parts of the inner flange and the outer flange and extending along the length of the inner-facing web.

In some embodiments, the hook receptacle comprises an upper wall, the hook and the upper wall of the hook receptacle having been brought into locking-type engagement with each other as a result of the bending of the nosing assembly.

In some embodiments, each of the outer-facing web, the inner-facing web, and the intermediate web has a web thickness of about 0.05 inch to about 0.09 inch, and the front facia flange has a web thickness greater than the thicknesses, taken individually, of the inner-facing web, the outer-facing web, and the intermediate web, the front facia flange having an average web thickness of about 0.08 inch to about 0.10 inch, and optionally, the nosing assembly has been bent about a radius of at least 12 inches.

In some embodiments, the invention comprehends a window frame having a straight side and an arcuate side, with an arcuate nosing assembly of the invention mounted to the arcuate side of the window frame, the drip cap and the nosing optionally being secured to each other by a locking engagement of the hook and the hook receptacle, the drip cap being devoid of fasteners driven therethrough and into the nosing at locations away from end portions of the drip cap.

In some embodiments, the window frame further comprises a fastener extending through the drip cap, and into the nosing, at each of the end portions.

In some embodiments, the invention comprehends a window comprising a window frame of the invention, and a glazing in the window frame.

In some embodiments, the window frame has at least first, second, and third sides joined to each other in end-to-end relationship, a first side comprising a nosing assembly of the invention, arranged in an arcuate configuration, with the inner flange disposed to the inside of the arc.

In some embodiments, the invention comprehends a nosing assembly made with a combination of nosing and drip cap of the invention where the drip cap and the nosing are assembled to each other with the stud in the stud receptacle, the stud and the stud receptacle so cooperating with each other as to inhibit movement of the drip cap toward or away from the third end of the outer flange, and a plurality of fasteners spaced along the length of the drip cap, including away from end regions of the drip cap, the plurality of fasteners holding the drip cap and the nosing in fixed longitudinal relationship to each other.

In some embodiments, fasteners extend through the drip cap and into the nosing through a plurality of mounting holes, and a flexible sealing compound is disposed between the drip cap and the nosing at the holes.

In some embodiments, the window frame has at least first, second, and third sides joined to each other in end-to-end relationship, at least one of the sides comprising a nosing assembly of the invention.

In a second family of embodiments, the invention comprehends a nosing assembly, comprising an elongate nosing having a nosing length, and comprising inner and outer flanges, and a plurality of webs connecting the inner and outer flanges to each other, an outer surface being defined on the outer flange, and a hook receptacle on one of the plurality of webs connecting the inner and outer flanges to each other, or on the outer flange, the hook receptacle being defined, at least in part, by one or more walls, including an upper wall; and an elongate drip cap, the drip cap comprising an elongate drip cap platform, having a platform upper surface and a platform lower surface, a first inner side and a second outer side, and a hook extending downwardly from the platform and toward one of the first inner side and the second outer side, the drip cap being assembled to the nosing with the hook in the hook receptacle.

In some embodiments, the nosing assembly has been bent about a radius of 12 inches or more, the hook and the hook receptacle being in locking-type engagement with each other so as to hold the drip cap and the nosing to each other at an interface between the outer surface of the outer flange and the lower platform surface of the drip cap.

In some embodiments, a flexible sealing compound extends along the interface between the nosing and the drip cap, from the first end of the nosing assembly to the second end of the nosing assembly.

In some embodiments, the hook and the hook receptacle cooperate with each other to inhibit movement of the drip cap toward or away from the third end of the outer flange and wherein the hook so engages the hook receptacle at an upper wall of the receptacle as to prevent movement of the drip cap perpendicularly away from the outer flange of the nosing.

In some embodiments, a first framed window comprises an arcuate window frame, having a straight side comprising a first insert and a first insert receptacle, a second framed window comprises a second insert and a second insert receptacle. The first insert is received in the second insert receptacle and the second insert is received in the first insert receptacle, thereby to mount the first and second windows to each other.

In some embodiments, the invention comprehends a door assembly comprising a framed door, and an attached arcuate window frame of the invention.

In a third family of embodiments, the invention comprehends a method of making an arcuate nosing assembly for use in a window having an arcuate side. The method comprises assembling together an elongate nosing and an elongate drip cap. The nosing has inner and outer flanges, and a plurality of webs connecting the inner and outer flanges to each other, an outer surface being defined on the outer flange, and a hook receptacle defined on one of the plurality of webs connecting the inner and outer flanges to each other, or on the outer flange. The drip cap comprises an elongate drip cap platform, having a platform upper surface and a platform lower surface, a first inner side and a second outer side, and a hook extending downwardly from the platform and toward one of the first inner side and the second outer side. The nosing and the drip cap are assembled with the hook engaged in the hook receptacle. The method further comprises bending the assembly of the nosing and the drip cap, with the inner flange to the inside of the bend and thereby re-forming the combination of the hook and the hook receptacle so as to bring the hook and the hook receptacle into a tightened locking-type engagement with each other.

The present invention will be further appreciated and understood when considered in combination with the following description and the accompanying drawings. It should be understood, however, that the following description is given by way of illustration and not of limitation. Certain changes and modifications can be made within the scope of the invention without departing from the spirit of the invention, and the invention includes all such changes and modifications.

Figure 1:
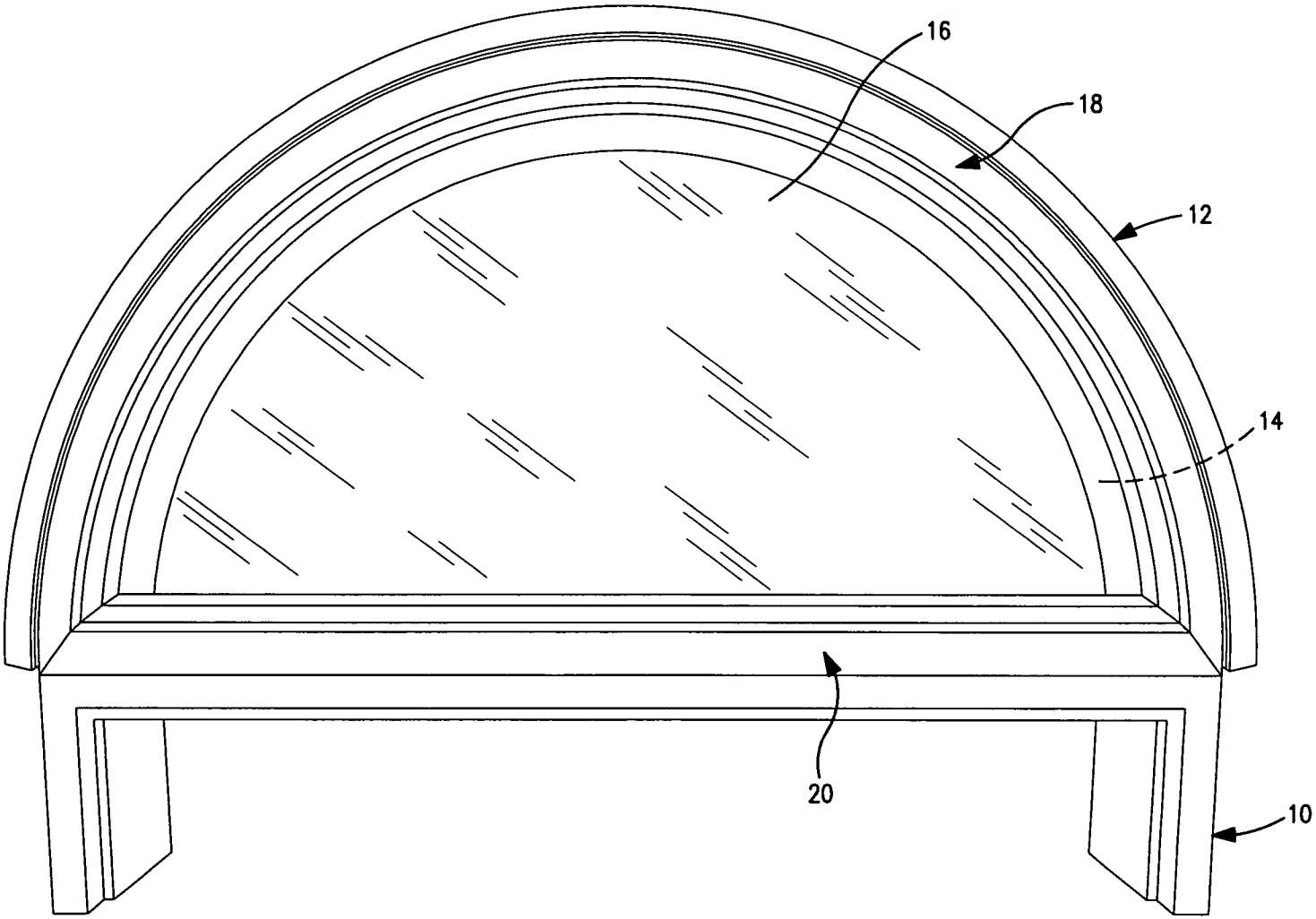
FIG. 1 illustrates a front elevation view of an assembly comprising a transom window mounted over a door frame, with the door frame being shown in part.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Figure 2:
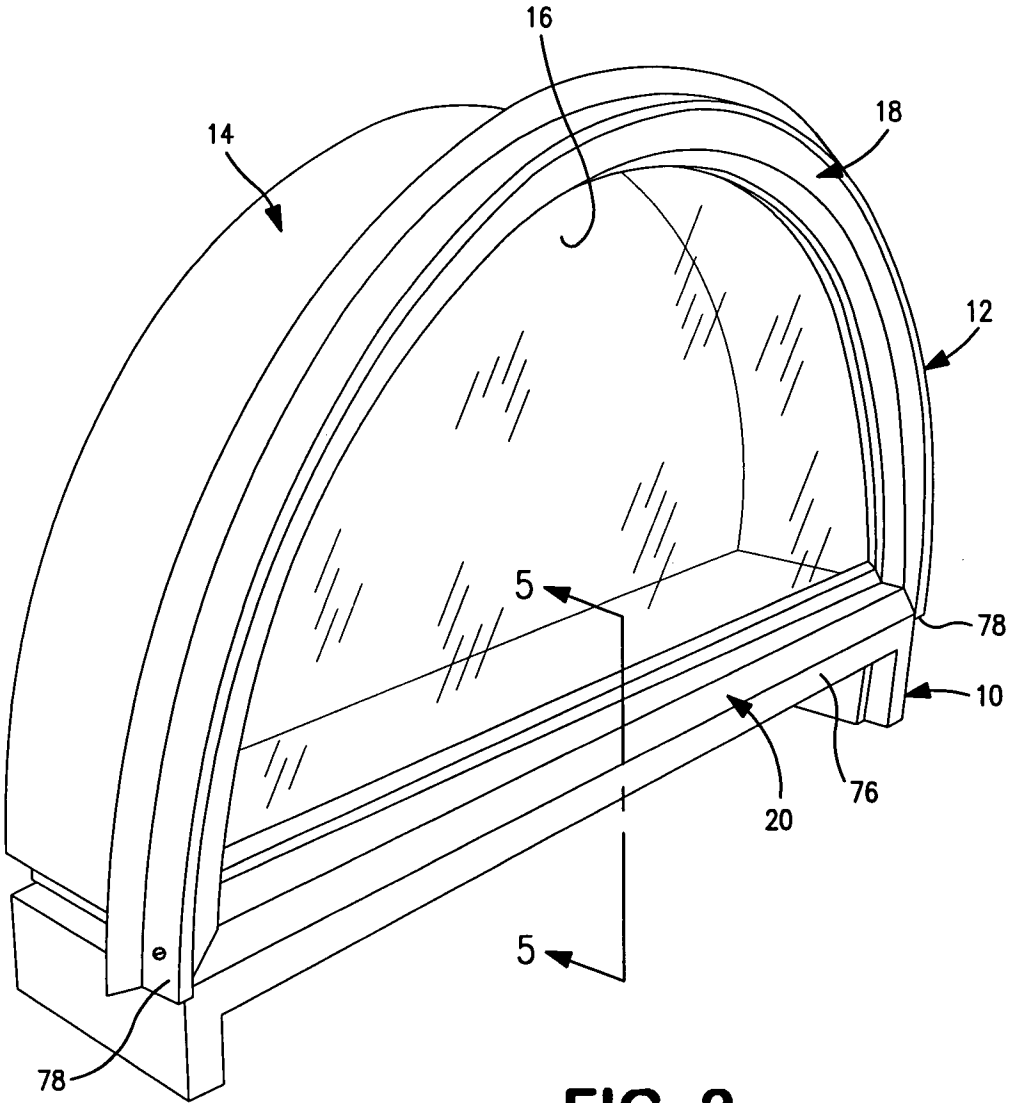
FIG. 2 shows a pictorial view of the assembly of FIG. 1.

FIG. 1 illustrates a front view of a cladded arcuate transom window of the invention mounted on the top of a cladded door frame, with only the top portion of the door frame being shown. FIG. 2 shows the same arcuate transom window mounted at the top of the same door frame, in orthogonal view. As seen in FIGS. 1 and 2, the door frame in general is represented by the number 10. The transom window 12 of the invention is mounted on the door frame by structure described hereinafter.

Window 12 includes a window frame 14 illustrated as being made of wood, a glazing unit 16 mounted in the window frame, an elongate arcuate extruded aluminum nosing assembly 18, and an elongate straight extruded aluminum nosing 20. Arcuate nosing assembly 18 is mounted to the upper, arcuate portion of the window frame. Straight nosing 20 is mounted to the lower, straight portion of the window frame.

Figure 3:
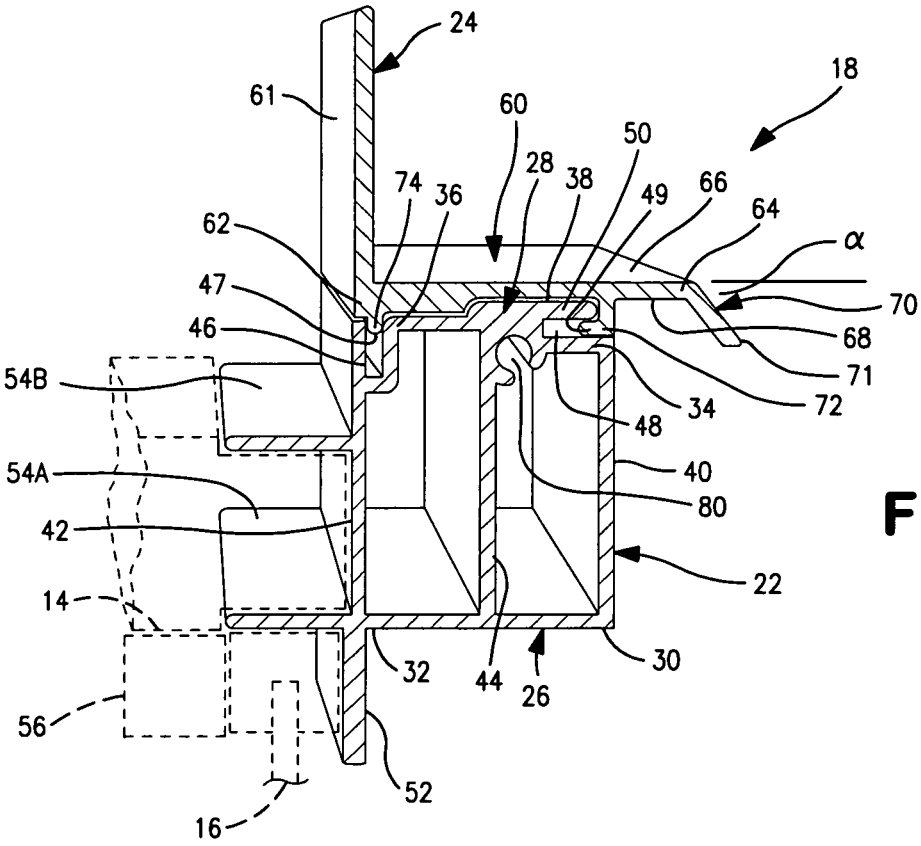
FIG. 3 shows a cross-section of a short length of a straight nosing assembly of the invention, illustrating locations of the window framing, the glass stop, and the glazing assembly.
Figure 4:
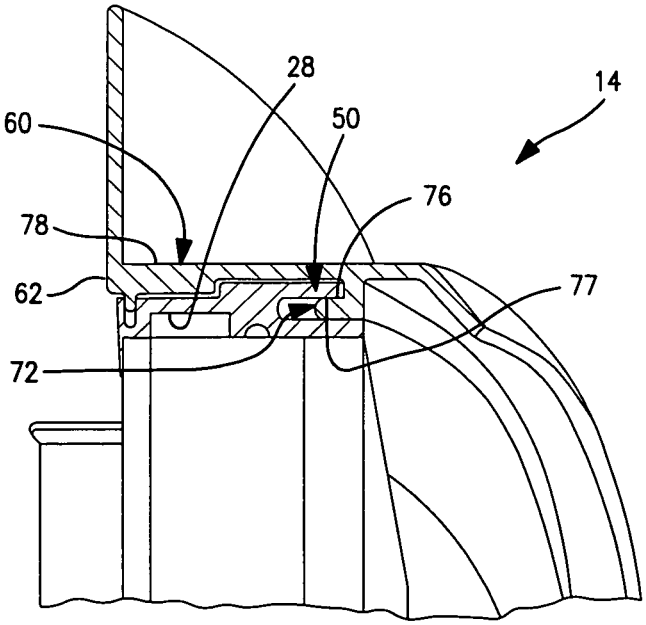
FIG. 4 shows an upwardly-directed end view of the assembly of FIGS. 1 and 2, illustrating the cooperative crimping affect of the hook in the hook receptacle when the nosing assembly is bent, thus securing the drip cap on the nosing by means of the bending process.

Referring now to FIGS. 3 and 4, FIG. 3 shows a short length of a combination of a nosing 22 and a drip cap 24, in their as-extruded, straight configurations, with the drip cap and nosing temporarily assembled to each other. FIG. 4 shows the elongate combination mounted to the window frame after the nosing and drip cap have been bent into the desired arcuate configuration, with corresponding securement of the nosing and drip cap to each other during the bending process.

Turning back to FIG. 3, nosing 22 has an inner flange 26, and an outer flange 28 spaced from the inner flange. Inner flange 26 has a first outer end 30 and a second inner end 32. Outer flange 28 has a third outer end 34, a fourth inner end 36, and an outer surface 38.

An elongate outer-facing web 40 connects to the inner and outer flanges at outer ends 30 and 34. Elongate inner-facing web 42 connects to the inner and outer flanges at inner ends 32 and 36. Elongate intermediate web 44 connects to intermediate portions of the inner and outer flanges.

An elongate stud-receiving receptacle 46, adjacent inner-facing web 42, has an opening 47 extending downwardly and toward the inner flange, from outer surface 38 of outer flange 28. An elongate hook-receiving receptacle 48 has an opening 49 adjacent outer end 34 of outer flange 28. The hook-receiving receptacle extends from the opening 49 toward inner-facing web 42. The hook-receiving receptacle includes a remote upper wall 50 defined between the main body of the receptacle and the upper surface 38 of outer flange 28. Remote upper wall 50 of the hook-receiving receptacle is generally spaced from the remaining portions of nosing 22.

Elongate front facia flange 52 extends downwardly from the inner flange 26, generally as an extended element of inner-facing web 42. In the illustrated embodiment, the front facia flange has a substantially thicker cross-section than either the adjacent inner flange 26 or the adjacent inner-facing web 42.

A first elongate mounting finger 54A extends generally as an extension of the inner flange from the joinder of the inner flange and the inner-facing web. A second elongate mounting finger 54B is spaced from the first mounting finger, generally parallel to the first mounting finger, and extends from the inner-facing web away from the outer-facing web. FIG. 3 shows, in dashed outline, a portion of the window frame 14 which fits between mounting fingers 54A and 54B, including the recesses cut into the frame member such that the outer surface of the frame member represents a generally continuous surface with the corresponding outer surface of the second mounting finger.

FIG. 3 also illustrates in dashed outline the glazing stop 56 which abuts glazing assembly 16, also shown in dashed outline. Glazing assembly 16 abuts front facia flange 52. Flange 52, glazing assembly 16, the illustrated frame element 14, and glazing stop 56 thus illustrate the relative positioning of the main body of the window frame, the upper arcuate nosing assembly, and the window glazing assembly.

Returning to the nosing assembly, elongate drip cap 24 has a platform 60 and a drip flashing flange 61. Platform 60 has an inner end 62, an outer end 64, an upper surface 66, and a lower surface 68. An elongate drip flange 70 extends downwardly from outer end 64 of the platform at an angle "α" of about 30 degrees, more or less in the embodiment illustrated. Angle "α" is required to, and the magnitude of angle "α" is selected to, direct water away from the window frame to a drip edge 71. Thus, the magnitude of angle "α" can vary depending on the particular implementation. An elongate hook 72 extends down from a locus on the platform lower surface which locus is generally toward outer end 64; and the hook extends from there toward inner end 62 of the platform.

An elongate stud 74 extends downwardly from the lower surface 68 of the platform, adjacent inner end 62 of the platform.

The nosing assembly illustrated in FIG. 3 is designed to loosely fit together such that, at initial assembly of the straight extruded elements, the drip cap and nosing can readily slide longitudinally with respect to each other with limited, if any, noticeable friction.

The straight drip cap and the straight nosing can be initially joined together by longitudinally sliding the drip cap and nosing with respect to each other, with the hook engaged in the hook receptacle. With the hook so engaged, the stud is automatically aligned over the stud receptacle and is readily engaged in the stud receptacle.

As a second method of joining the nosing and the drip cap, the nosing and drip cap can be brought together with the lower surface of the drip cap overlying the upper surface of the outer flange, and with the leading edge of the hook at opening 49 of the hook receptacle. With the hook so positioned, the stud is proximate, but displaced from, stud receptacle 46. The drip cap is then slid toward fourth inner end 36 of outer flange 28, to a stop location where the structure of the platform or nosing stops the engaging of the hook into the hook receptacle and the stud is in alignment over the stud receptacle. With the hook so-engaged and fully seated in the hook receptacle, the stud is readily seated in the stud receptacle. Full engagement of the hook and the stud, thus brings the drip cap and the nosing into registered alignment with respect to each other relative to the inner and outer webs, e.g. such that the inner end of the drip cap platform is aligned with the inner end of the outer flange of the nosing.

The nosing and drip cap are easily disassembled from each other at this stage by simply raising the inner end of the drip cap, thus disengaging the stud from the stud receptacle and then sliding the drip cap relatively toward the outer-facing web. As a second disassembly technique, the drip cap can simply be slid longitudinally with respect to the nosing.

With the drip cap so-joined to the nosing, as a temporary assembly that can be readily separated, the temporary assembly can be converted to a permanently-mounted assembly having an arcuate shape. To make such conversion, the temporary assembly is mounted in a bending jig or other suitable machine. The nosing/drip cap assembly combination is then bent into a desired arcuate configuration, typically in a cold-forming process, bending both the drip cap and the nosing together as a single unit. In the illustrated embodiments, the assembly is bent with the inner flange of the nosing disposed toward the interior of the bend and the drip cap platform disposed toward the outside of the bend.

As the bending force is applied collectively to both nosing 22 and drip cap 24, both the nosing and the drip cap, bending together, take on bent configurations generally similar to each other. As the bending force is released, and the normal limited rebound of the cold-formed elements occurs, the now-arcuate upper surface 76 of hook 72 is left in a forceful abutting-type surface-to-surface engagement with the arcuate lower surface 77 of upper wall 50, as illustrated in FIG. 4. The surface-to-surface engagement locks the nosing and drip cap to each other, creating the nosing assembly, and provides a stabilizing frictional relationship between the hook and the remote upper wall of the hook receptacle, holding the drip cap and the nosing firmly engaged with, and locked to, each other such that no additional measures need be taken to retain the now-arcuate nosing and the now-arcuate drip cap in the assembled relationship with each other.

In addition to the locking of the nosing and the drip cap to each other, the resulting abutting engagement between the hook and the hook receptacle, and the convoluted path around hook 72, around wall 50, and along the interface between outer flange 28 and platform 60, to inner end 62, serves as a barrier to air-borne water penetrating to inner end 62 of the nosing assembly where such water can potentially reach water-susceptible wood frame 14. Applicant contemplates that such barrier is effective to prevent weather-generated water penetration except, perhaps, in dangerously-violent weather conditions.

In the arcuate embodiments built to date, of which FIGS. 1, 2, and 4 are representative, it appears that the rebounded drip cap tends to stabilize after the bending operation, with the ends 78 of the drip cap drawn away from the nosing at inner end 62 of the platform, by up to e.g. about 0.15 inch. Such spacing of the inner ends 78 of the drip cap from the nosing can be readily remedied by driving a single screw (not shown) through platform 60 and into outer flange 28 of the nosing in each end region of the arcuate nosing assembly, e.g. between inner-facing web 42 and intermediate web 44. Tightening such screws draws the inner end 62 of the platform into intimate relation with outer flange 28, thus essentially eliminating the open space between the drip cap and the nosing at inner ends 62, namely holding the elements in the configuration shown in FIG. 4. Thus, the invention eliminates all except two of the assembly screws which are used in conventional nosing/drip cap assemblies.

And, in order to better insure that the two screws which are used are not entry points for water getting into the window frame, once the screw holes are drilled after the drip cap and nosing are bent, caulk or other flexible sealing compound is forced/injected between the drip cap and the nosing, from the ends of the drip cap and nosing, to and past the screw holes. When a screw is installed, and the drip cap and nosing are drawn together, the space between the drip cap and the nosing, at the ends of the nosing and drip cap, is closed. As the distance between the nosing and drip cap is closed, the caulk is forced to spread in the narrowing space, filling voids between the screw and the side walls of the holes, and occupying the space between the nosing and the drip cap. This application of caulk, including the method of spreading the caulk about the holes which present potential water entry points, essentially eliminates risk of water entering the window frame through the screw holes.

The observed abutting surface-to-surface locking-type engagement of the hook and the upper wall of the hook receptacle, with each other, may be at least in part caused by re-forming of the configuration of the hook 72 relative to the hook receptacle 48 as the nosing and the drip cap take on the arcuate configuration, as well as by the collective rebound from the forming/bending operation. Whatever the mechanism, the bending of the nosing and the drip cap, collectively as the nosing assembly, brings the nosing and the drip cap into an essentially inseparable locked engagement at hook 72 and upper wall 50 as illustrated in FIG. 4, with the hook and hook receptacle providing a substantial barrier to water penetrating into the frame through the resulting nosing assembly.

Both hook receptacle 48 and stud receptacle 46 extend to depths substantially greater than the depths reached by the hook or the stud. The space between the end of the stud and the end of the stud receptacle is greater than the space occupied by the stud in the receptacle. Similarly, the space between the end of the hook and the end of the hook receptacle is greater than the space occupied by the hook in the hook receptacle. Such greater depths allow for flow of material during the bending of the initially-joined nosing/drip cap assembly.

While hook receiving opening 48 is illustrated on the outer flange, opening 48 can as well be located on the outer-facing web or the inner-facing web. And while the hook receptacle is shown extending toward the inner-facing web, it could as well extend toward the outer-facing web.

What is important for the hook receptacle is that the receptacle extend in such direction that an upper wall of the receptacle, or other structure which is capable of cooperating with a hook to re-form and/or engage the combination, is defined as part of the hook receptacle. In the illustrated embodiment, the combination is re-formed such that the hook and the upper wall of the receptacle are brought into the firm abutting-type locking engagement whereby the drip cap and the nosing are securely bound to each other.

The opening for the hook receptacle can be located on the outer flange as shown, or on the inner-facing web, or on the outer-facing web. For example, opening 49 can be located anywhere along the height of the outer-facing web, e.g. between inner and outer flanges 26 and 28, whereby hook 72 extends down the face of the outer-facing web 40 to the opening. A similar arrangement can, in the alternative, be defined for the inner-facing web 42. When the assembly is bent and released, both the hook, as part of the drip cap, and the receptacle as part of the nosing, are re-formed, and the resulting abutting-type locking engagement is created.

The hook receptacle is illustrated remote from drip flashing flange 61 and the stud receptacle is illustrated proximate the drip flashing flange. The hook receptacle and the stud receptacle can be relocated to generally reversed relative positions, and are typically spaced from each other. The hook and stud are correspondingly relocated also.

In the illustrated embodiments, the nosing and drip cap are elongate aluminum extrusion profiles. As such, each element defined in such profiles typically extends, as extruded, for the full length of the respective profile. Thus, the extrusions generally function as cladding, covering/cladding surfaces of the wood substrate elements which generally provide the structural substance of the window frame and which surfaces would otherwise be exposed to the ambient environment.

While the description herein addresses primarily wood substrates for window and door frames, the substrates can be any desired material including, without limitation, solid plastic substrates, extruded profile plastic substrates, extruded aluminum profiles, pultruded fiberglass-reinforced profiles, or combinations of any of the above, with or without wood elements.

In the illustrated embodiment of FIGS. 3-4, the extruded aluminum profile elements in the nosing are generally 0.05 inch thick. Thus, inner and outer flanges 26 and 28, webs 42, 44, and 46, drip flashing flange 61, and mounting fingers 54A and 54B are all generally about 0.04 inch to about 0.06 inch thick, allowing for the thicker structure on outer flange 28 which supports upper wall 50 of the hook receptacle, and the illustrated screw boss. Facia flange 52 is about 0.07 inch to about 0.10 inch thick, optionally about 0.08 inch to about 0.10 inch thick, as it has surprisingly been found that a thicker facia flange 52 can better receive the material flow during the bending process, without buckling. Drip cap platform 60 is about 0.09 inch to about 0.12 inch thick proximate inner end 62 and about 0.04 inch to about 0.06 inch thick adjacent outer end 34 and screw boss 80.

EXAMPLE 1

Making an Arcuate Nosing Assembly

Referring to FIG. 3, a straight, loosely-assembled nosing assembly was made having approximately the following material thicknesses. Inner and outer flanges 26 and 28, webs 42, 44, and 46, drip flashing flange 61, and mounting fingers 54A and 54B were all generally about 0.05 inch thick, allowing for the thicker structure on outer flange 28 which supports hook finger 50 and the illustrated screw boss. Facia flange 52 was about 0.09 inch thick. Drip cap platform 60 was about 0.09 inch thick proximate inner end 62 and about 0.045 inch thick adjacent outer end 34 and screw boss 80.

The general size of the nosing profile as seen in FIG. 3 was about 1.25 inches high and about 1 inch wide. Facia flange length was about 0.5 inch. Platform length was, left-to-right, about 1.25 inches. Flashing flange height was about 1.1 inches. Mounting fingers 54A, 54B were about 0.5 inch wide. In the loosely-assembled assembly, with stud 74 in stud receptacle 46, and hook 72 in hook receptacle 48 as illustrated in FIG. 3, the drip cap was readily longitudinally slidable relative to the nosing. For disassembly, the drip cap was readily slidable toward the outer-facing web after raising stud 74 out of stud receptacle 46, thus to release the drip cap from the nosing.

The thus loosely-assembled straight assembly was then placed in a bending jig and bent about an approximately 18-inch radius, measured from the inner flange, into a half-circle, and released from the bending operation. Once released, the assembly retained its general half-circle configuration and the resulting bent assembly exhibited a strong securement of the drip cap and nosing to each other along the bent length, such that the drip cap and the nosing were essentially inseparable from each other along the bent length. A strong abutting-type locking engagement was noted between hook 72 and upper wall 50. Thus, upon completion of the bending process, the drip cap and the nosing were in a locked relationship with each other.

Given the 18-inch radius bend in the subject nosing assembly, the inventor contemplates that even shorter radius bends such as 15 inches radius, or 12 inches radius, or 7.5 inches radius, may be achieved with little if any modification to the disclosed profiles and such shorter-radius profiles are thus considered to be part of the invention. The inventor contemplates that, in light of the disclosure herein, substantially any radius equal to half of the width of conventional commercially-available windows and doors, down to e.g. about 6 inches radius, can be accommodated by making obvious modifications to the nosing and drip cap profiles in order to achieve some of the smaller such radii whereby all such radii are considered to be enabled by the disclosure herein.

The above portion of the detailed description generally refers to the upper arcuate portion of transom window frame 14. Turning now to the interface between transom window 12 and door frame 10, reference is made to FIGS. 1 and 2, and especially to FIG. 5, where nosing 20 joins the lower portion of the transom window to the upper portion of the underlying clad door frame.

Figure 5:
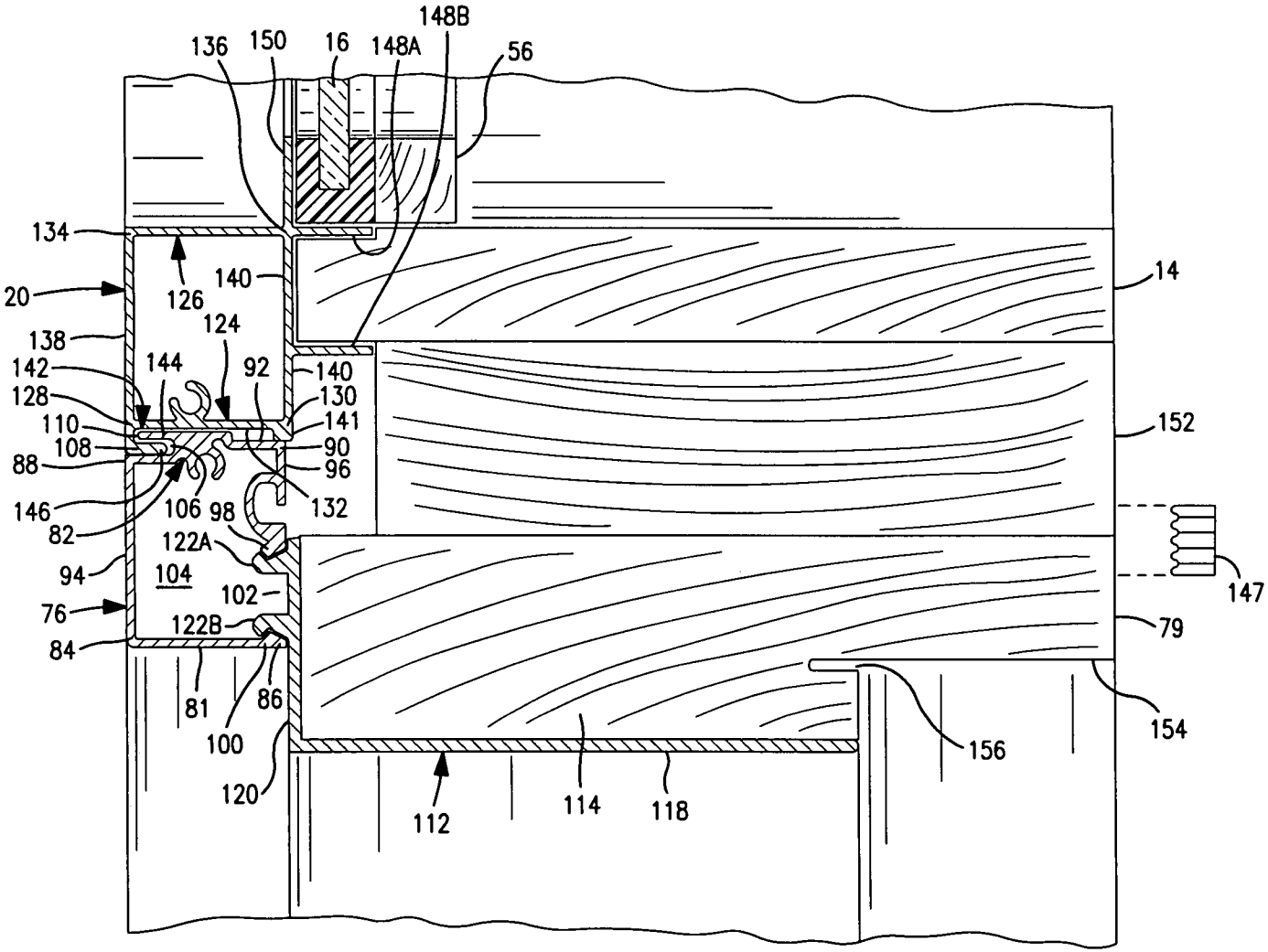
FIG. 5 shows a cross-section taken at 5-5 of FIG. 2 illustrating the horizontal joint between the underlying door frame and the overlying arcuate transom window.

Turning now to FIG. 5, nosing 76 on header jamb 79 of the clad door frame interfaces with nosing 20 on the window frame.

As seen in FIG. 5, nosing 76 has an inner flange 81, and an outer flange 82 spaced from the inner flange. Inner flange 81 has a first outer end 84 and a second inner end 86. Outer flange 82 has a third outer end 88 and a fourth inner end 90, and an outer surface 92.

An elongate outer-facing web 94 connects to the inner and outer flanges at outer ends 84 and 88. Elongate inner-facing web 96 connects to the outer flange at inner end 90 and extends toward inner end 86.

A first lock 98 on the inner-facing web and a second lock 100 at the inner end 86, of the inner flange define an opening 102 which extends from outside the nosing, between the first and second locks, and into the interior space 104 inside the nosing.

An elongate receptacle 106 has an opening 108 where third outer end 88 of outer flange 82 and the upper end of outer-facing web 94 come together. Thus, opening 108 can be considered either as part of outer flange 82 or as part of web 94. Receptacle 106 extends from opening 108 toward inner-facing web 96. Receptacle 106 includes a remote upper wall 110 defined between the main body of the receptacle and the outer surface 92 of outer flange 82. Remote upper wall 110 is generally spaced from the remaining portions of nosing 76.

Nosing 76 is mounted to jamb cover 112. Jamb cover 112 covers the surfaces of an e.g. wood jamb substrate 114 of the header jamb 79 of the door frame, thus, generally functioning as cladding and thereby covering surfaces of the wood substrate elements which generally provide the structural substance of the door frame and which surfaces are otherwise exposed to ambient environmental conditions. Jamb cover 112 has a main side panel 118 which covers that side of the e.g. wood substrate which faces into the doorway opening. Outer panel 120 of the jamb cover is joined to main side panel 118 at a common corner, and covers the side of the substrate which faces away from the building. Lock structure extends from the outer panel in the physical expression of two lock studs 122A, 122B. Lock studs 122A, 122B interface with first and second locks 98 and 100 on the nosing 76.

Jamb cover 112 can be mounted to the substrate by e.g. screws or other fasteners, not shown, at screw apertures, not shown, between lock studs 122A and 122B, such apertures being spaced along the length of the jamb cover.

Given the relative flexibility in the respective locks on the extruded aluminum nosing 76 and jamb cover 112, nosing 76 can be secured/mounted to the jamb cover, and thus to the illustrated header jamb, by snap-locking the first and second locks 98 and 100 on nosing 76 to studs 122A and 122B on the jamb cover.

Nosing 20 has an inner flange 124, and an outer flange 126 spaced from the inner flange. Inner flange 124 has a fifth outer end 128, a sixth inner end 130, and an inner surface 132. Outer flange 126 has a seventh outer end 134 and an eighth inner end 136.

An elongate outer-facing web 138 connects to the inner and outer flanges at outer ends 128 and 134. Elongate inner-facing web 140 connects to the inner and outer flanges at inner ends 130 and 136. An elongate spacing stud 141 extends down from inner surface 132 of inner flange 124. Spacing stud 141 thus spaces the inner flange of nosing 20 from the outer flange of nosing 76 by a distance which maintains the inner flange of nosing 20 in a generally parallel relationship with the outer flange of nosing 76 for the full depth, between the inner-facing webs and the outer-facing webs, of nosings 76 and 20, whereby outer-facing webs 94 and 138 define a generally common and flat surface.

An elongate receptacle 142 proximate fifth outer end 128 of nosing 20 has an opening 144 spaced, from outer end 128, toward the sixth inner end 130 of inner flange 124. Receptacle 142 extends from opening 144 toward outer-facing web 138. Receptacle 142 includes a remote lower wall 146 defined between the main body of the receptacle and inner surface 132 of inner flange 124. Remote lower wall 146 is generally spaced from the remaining portions of nosing 20.

A first elongate mounting finger 148A extends generally as an extension of outer flange 126 from the joinder of outer flange 126 and inner-facing web 140. A second elongate mounting finger 148B is spaced from the first mounting finger and extends from the inner-facing web away from the outer-facing web, generally parallel to mounting finger 148A. FIG. 5 shows a portion of the window frame 14 which fits between mounting fingers 148A and 148B, including a recess cut into the upper surface of the frame member such that the upper surface of the frame member represents a generally continuous surface with the corresponding outer surface of the first mounting finger.

Elongate front drip flange 150 extends upwardly from the outer flange, generally as an extended element of inner-facing web 140.

FIG. 5 also illustrates glazing stop 56 which abuts glazing assembly 16. Glazing assembly 16 abuts front drip flange 150. Flange 150, glazing assembly 16, glazing stop 56, and mounting fingers 148A and 148B, along with frame elements 14, thus illustrate the relationships of the main elements of the window frame with the nosing and the glazing assembly.

FIG. 5 further shows a side view of an elongate window support 152 which is mounted to the bottom of window frame 14 and which extends from a location proximate mounting finger 148B toward the interior of the building to which the door frame is mounted, generally to the inner end of the door frame. A plurality of supports 152 are spread along the left-to-right width of the header jamb and support the window from the underlying door frame at header jamb 79. Spacing between supports is such as to adequately support the weight of the overlying window assembly. For e.g. a 36-inch wide half-circle transom window, three supports, each about 1 inch wide and extending the full depth of the frame behind the mounting fingers, are adequate for such support function.

In assembling the door frame, left and right side jambs are joined to a header jamb, and optionally to a threshold. In assembling the window frame, the arcuate upper frame section is assembled to the lower straight frame section.

The items illustrated in FIG. 5 are typically assembled first as a door frame and a window frame. The top of the door frame is at header jamb 79. Jamb cover 112 is assembled to jamb substrate 114. Nosing 76 is snap-locked, to the jamb cover, thus to join the nosing 76 to the door frame.

The bottom of the window assembly is at the bottom of supports 152. Nosing 20 is mounted to the window frame as illustrated in FIG. 5, with e.g. staples or other fasteners (not shown) driven through mounting fingers 148A, 148B into the wood of the window frame 14.

EXAMPLE 2

Mounting Transom Window to Door Frame

The window frame and door frame can be assembled to each other as follows. With the door frame held stationary, the window frame is positioned generally as illustrated in FIG. 5, but with the window frame juxtaposed slightly ahead of the door frame such that remote upper wall 110 is at opening 144 and remote lower wall 146 is at opening 108. Upper wall 110 is parallel with, and aligned with, opening 144. Lower wall 146 is parallel with, and aligned with, opening 108. Supports 152 are generally positioned at the upper surface of the header jamb as shown.

An e.g. manual pushing force is then engaged at the bottom of the window frame, pushing rearwardly, e.g. on nosing 20, toward fourth inner end 90 of the outer flange of nosing 76. The force required to push the window rearwardly is typically, though not necessarily, within the capability of an average adult. As the window is pushed rearwardly, remote upper wall 110 of nosing 76 becomes at least temporarily engaged in receptacle 142 of nosing 20 and remote lower wall 146 of nosing 20 becomes at least temporarily engaged in receptacle 106 of nosing 76, thus locking nosings 76 and 20 to each other as shown in FIG. 5, with the lower surface of the upper nosing 20 generally in surface-to-surface relationship with the upper surface of the lower nosing 76.

In the assembly process, the window frame is moved rearwardly until the outer-facing web 138 on nosing 20 comes into alignment with outer-facing web 94 on nosing 76, such that the two outer-facing webs form a generally common surface as illustrated.

With the nosings so joined, and with the window frame located at its desired final juxtaposition relative to the door frame, the assembly is being held together at the outwardly-facing surface of the assembly, which will face outwardly of a building to which the assembly will be joined, by the interaction of upper wall 110 and lower wall 146 in the respective receptacles. Given the restraints provided by the interactions of the upper and lower walls 110, 146, no mull cap is needed or used to hold the two nosings in the desired nearer/further e.g. vertical relationship with respect to each other. While receptacle slots could be designed into the outer webs of nosings 20 and 76, such that a mull cap could be used, no such receptacles or mull caps are needed, and normally none are employed.

By avoiding the need to use a mull cap, the cost of the mull cap element is avoided, as is the labor cost of installing the mull cap. Also, the dirt and water penetration associated with the two conventional mull cap recesses is avoided. Further, the collective design of walls 110 and 146, along with the respective receptacles, provides ease of assembly, and ease of alignment of the underlying and overlying nosings with respect to each other so as to provide a generally common surface at the front face of the assembly, namely that face which is directed outwardly from the building.

The window is further secured to the door frame header at or adjacent the inwardly-facing surfaces of the assembly. For example, a corrugated sheet fastener 147, illustrated to the right of the header jamb and the supports in FIG. 5, can be driven into the inner faces of the header 79 and supports 152 as suggested by the illustration in FIG. 5. A conventional such fastener is a corrugated metal sheet, sharpened on one corrugated end, and driven into the wood elements of header 79 and a support 152 thereby to bridge the joint between the header and the support. With a plurality of fasteners so driven while outer-facing webs 94, 138 are held in a common surface, and with the nosings joined at receptacles 106 and 142, the door frame and the window frame are securely joined to each other in permanent assembly and outer-facing webs exhibit a common surface.

Other methods of securing the window and door to each other are contemplated, such as nails and/or screws toe-nailed through the joint at the inner faces. Or screws or nails can be driven through the wood surface 154 of that portion of the jamb which faces the doorway opening, especially adjacent or under weather seal kerf 156 where such fasteners will be hidden by the weather seal.

The spacings and tolerances of the remote upper and lower walls of the nosings, and the corresponding receptacles are such that the engagements of the upper and lower walls of the respective nosings in the receptacles are substantial frictionally-restrained engagements, such that, even before the frames are further secured to each other at e.g. the inwardly-facing surfaces of the assembly, the nosings tend to remain engaged with each other under modest handling and are not generally released from each other by the action of gravity, even if the temporarily-engaged assembly is re-oriented with limited support for one or more of the door frame and/or the window frame in the assembly.

Within the same context, disengagement of the window frame and the door frame from each other is accomplished by e.g. manually pulling the base of the window frontward toward nosing 76, and tilting the window so spacing stud 141 will clear top surface 92 of nosing 76.

While the process of joining, and disengaging, the nosing and drip cap to the door frame has been described in terms of the window frame being moved relative to the door frame, the joining and disengaging of the nosing and drip cap can as well be accomplished by holding the window frame stationary and moving the door frame, or both the window frame and the door frame can be moved as part of the process of joining and/or disengaging the nosing and the drip cap.

While FIG. 5 illustrates the interface between a cladded door frame and an overlying transom window frame, the same interface, and the same assembly process, can be used to join a side-light window frame to a side jamb of a cladded door frame, including side-light frames on both side jambs of the door frame.

Figure 6:
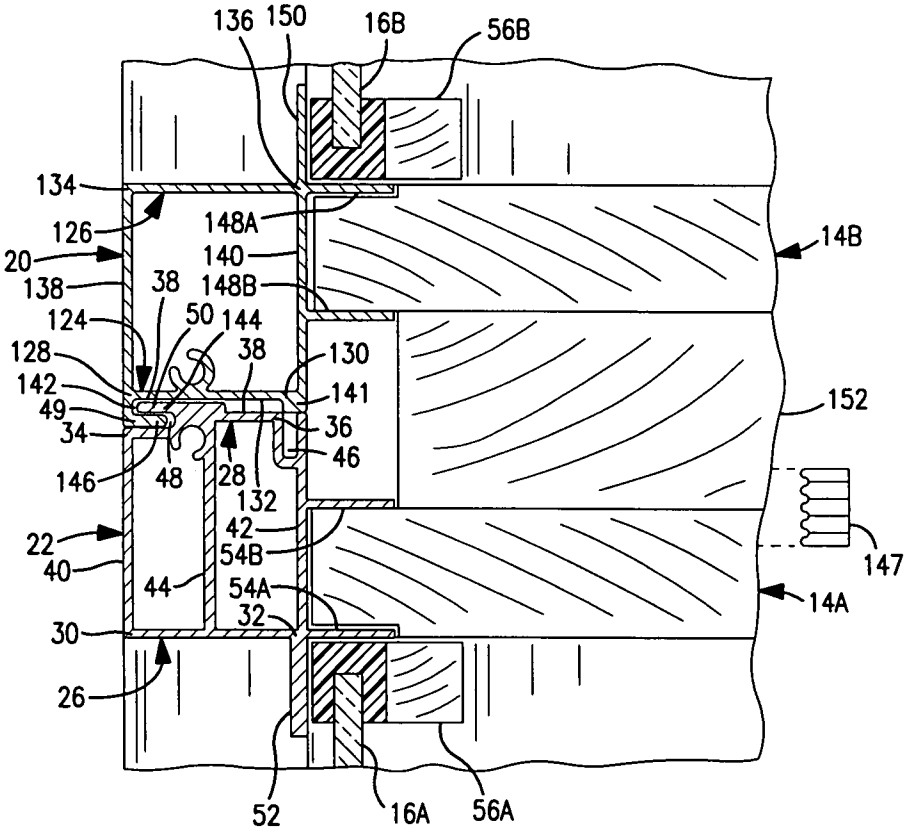
FIG. 6 shows a cross-section as in FIG. 5, but showing a horizontal joint between upper and lower windows.
Figure 7A:
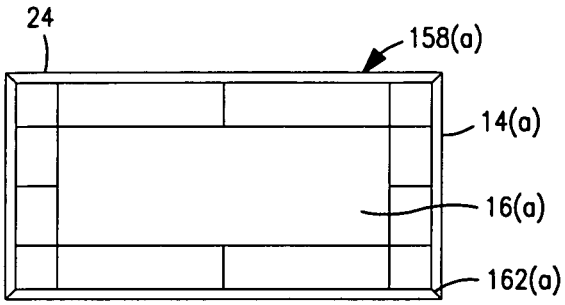
FIGS. 7(*a*)-7(*p*) show front elevation views of additional examples of shapes of windows of the invention, including windows which can be joined to each other and windows which can be joined to underlying door frames.
Figure 7B:
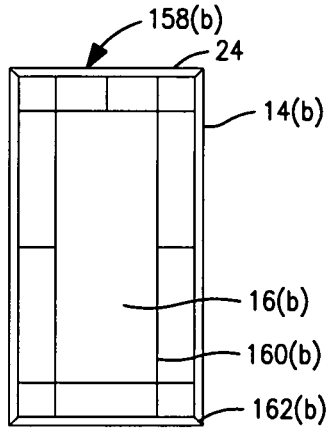
Figure 7C:
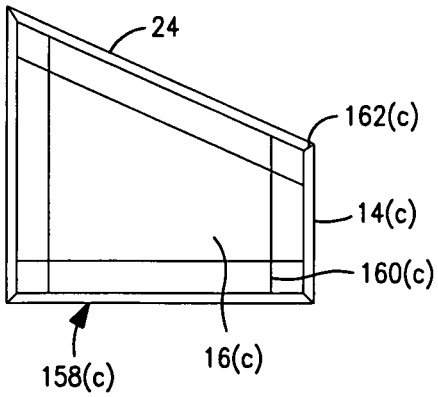
Figure 7D:
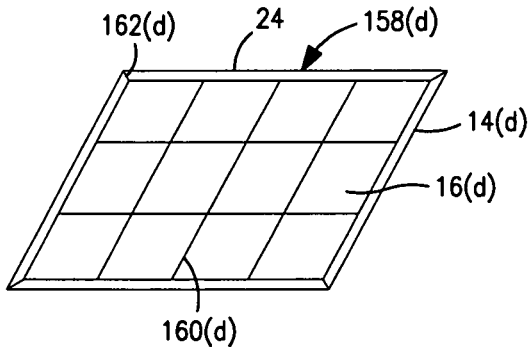
Figure 7E:
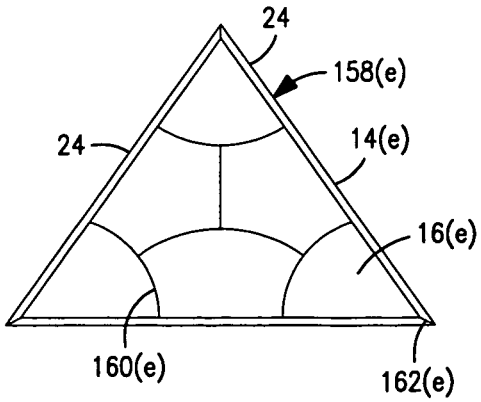
Figure 7F:
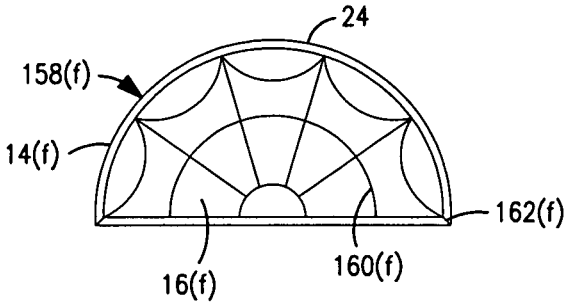
Figure 7G:
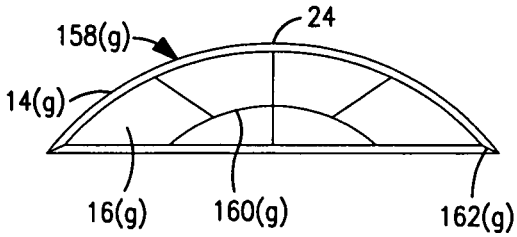
Figure 7H:
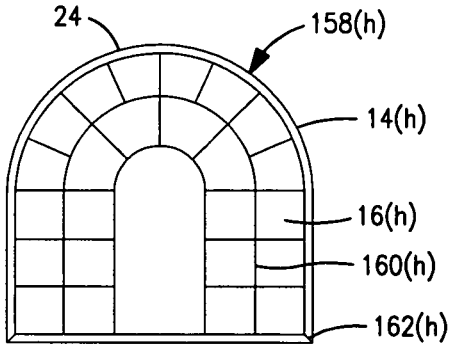
Figure 7I:
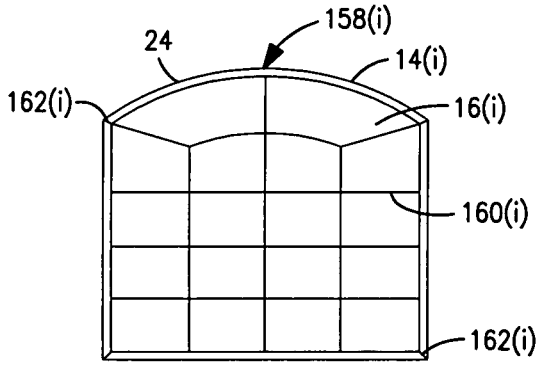
Figure 7J:
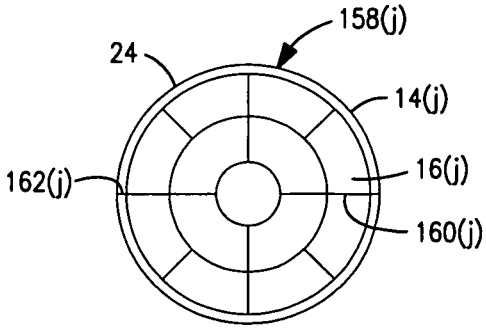
Figure 7K:
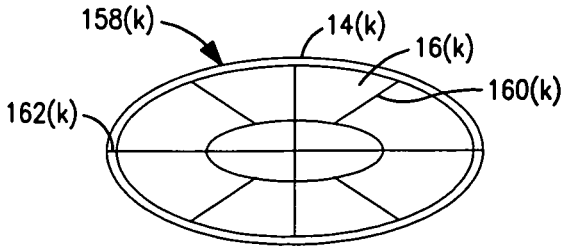
Figure 7L:
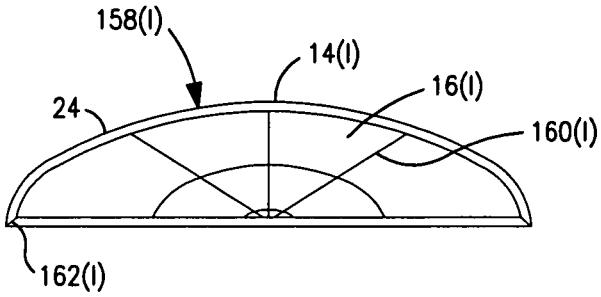
Figure 7M:
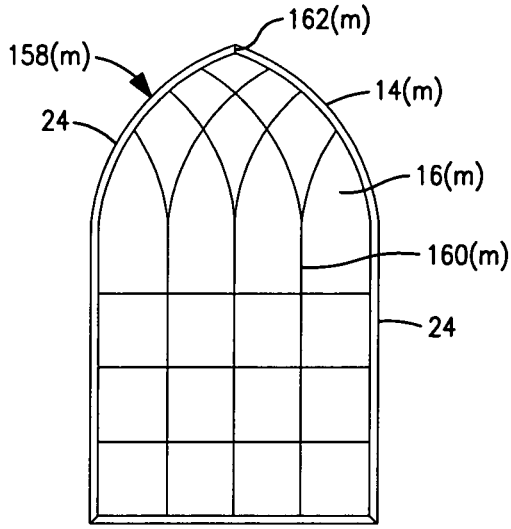
Figure 7N:
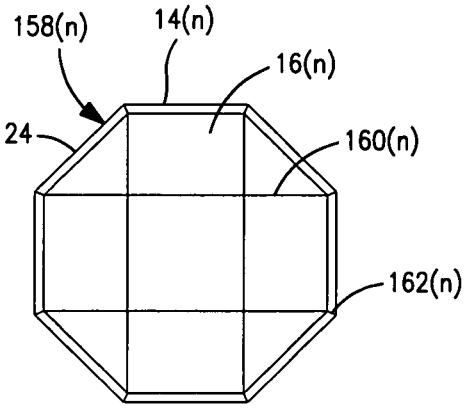
Figure 7O:
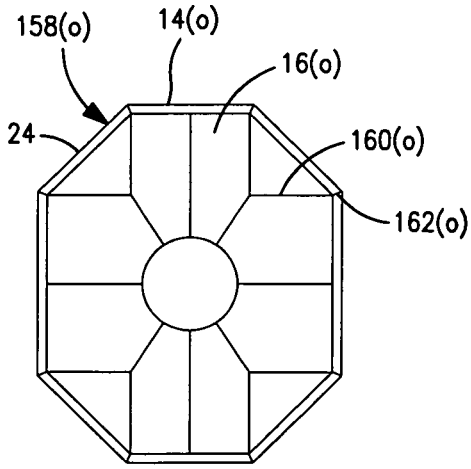
Figure 7P:
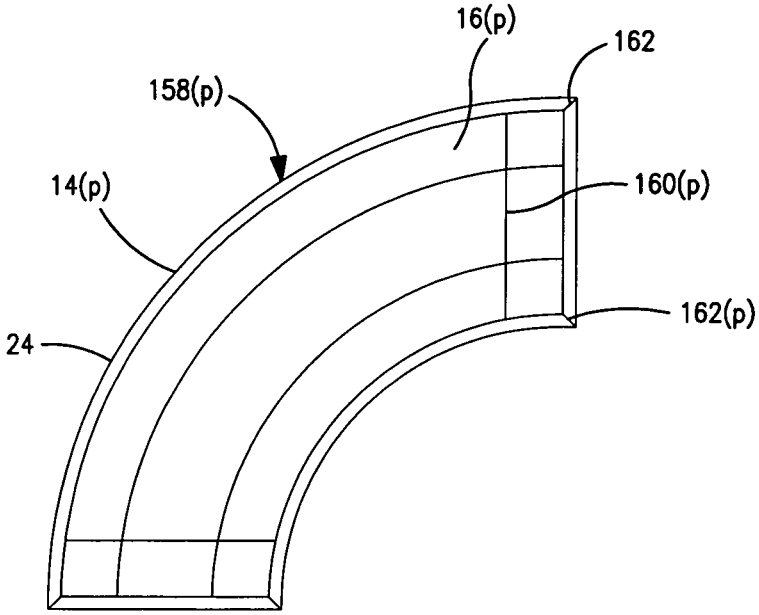

FIG. 6 illustrates the interface between first and second window frames 14A and 14B using interface structure similar to the interface structure shown in FIG. 5, but adapted to the joining of two window frames. In general, instead of using a door interface nosing 76 in combination with a window interface nosing 20 as in FIG. 5, window nosing 22 is used without bending the nosing, in combination with window nosing 20.

Thus, nosing 22 in FIG. 6 has inner flange 26, and outer flange 28 spaced from the inner flange. Inner flange 26 has first outer end 30 and second inner end 32. Outer flange 28 has third outer end 34, fourth inner end 36, and outer surface 38.

Elongate outer-facing web 40 connects to the inner and outer flanges at outer ends 30 and 34. Elongate inner-facing web 42 connects to the inner and outer flanges at inner ends 32 and 36. Elongate intermediate web 44 connects to intermediate portions of the inner and outer flanges.

Elongate stud-receiving receptacle 46, adjacent inner-facing web 42, extends downwardly and toward the inner flange, from outer surface 38 of outer flange 28.

Elongate hook-receiving receptacle 48 has an opening 49 adjacent outer end 34 of outer flange 28. The hook-receiving receptacle extends from the opening 49 toward inner-facing web 42. The hook-receiving receptacle includes a remote upper wall 50 defined between the main body of the receptacle and the upper surface 38 of the outer flange. Remote upper wall 50 of the hook receptacle is generally spaced from the remaining portions of nosing 22.

Elongate front facia flange 52 extends downwardly from inner flange 26, generally as an extended element of inner-facing web 42. In the illustrated embodiment, the front facia flange has a substantially thicker cross-section than either adjacent inner flange 26 or adjacent inner-facing web 42.

First elongate mounting finger 54A extends generally as an extension of inner flange 26 from the joinder of inner flange 26 and inner-facing web 42. Second elongate mounting finger 54B is spaced from the first mounting finger and extends from the inner-facing web away from the outer-facing web, generally parallel to first mounting finger 54A. FIG. 6 shows a portion of the window frame 14A which fits between mounting fingers 54A and 54B, including the recess cut into the frame such that the lower surface of the frame member represents a generally continuous surface with the corresponding inner-facing surface of the first mounting finger.

FIG. 6 also illustrates the glazing stop 56A which abuts glazing assembly 16A. Glazing assembly 16A abuts front facia flange 52. Flange 52, glazing assembly 16A, glazing stop 56A and frame member 14A, in combination, thus illustrate the relative positioning of the main body of the window frame, the nosing assembly, and the window glazing assembly.

Nosing 20 has inner flange 124, and outer flange 126 spaced from the inner flange. Inner flange 124 has fifth outer end 128, sixth inner end 130, and inner surface 132. Outer flange 126 has seventh outer end 134 and eighth inner end 136.

Elongate outer-facing web 138 connects to the inner and outer flanges at outer ends 128 and 134. Elongate inner-facing web 140 connects to the inner and outer flanges at inner ends 130 and 136. Elongate spacing stud 141 extends down from inner surface 132 of inner flange 124 thus to space the inner flange of nosing 20 from the outer flange of nosing 22 by a distance which maintains the inner flange of nosing 20 in a generally parallel relationship with the outer flange of nosing 22 for the full depths of nosings 20 and 22, between the inner-facing webs and the outer-facing webs.

An elongate receptacle 142 proximate fifth outer end 128 of nosing 20 has an opening 144 spaced, from outer end 128, toward the sixth inner end 130 of inner flange 124. Receptacle 142 extends from opening 144 toward outer-facing web 138. Receptacle 142 includes remote lower wall 146 defined between the main body of the receptacle and inner surface 132 of inner flange 124. Remote lower wall 146 is generally spaced from the remaining portions of nosing 20.

A first elongate mounting finger 148A extends generally as an extension of outer flange 126 from the joinder of outer flange 126 and inner-facing web 140. A second elongate mounting finger 148B is spaced from the first mounting finger and extends from the inner-facing web away from the outer-facing web. FIG. 6 shows a portion of the window frame 14B which fits between mounting fingers 148A and 148B, including a recess cut into the upper surface of the frame member such that the upper surface of the frame member represents a generally continuous surface with the corresponding outer surface of first mounting finger 148A.

Elongate front drip flange 150 extends upwardly from the outer flange, generally as an extended element of inner-facing web 140.

FIG. 6 also illustrates glazing stop 56B which abuts glazing assembly 16B. Glazing assembly 16B abuts front drip flange 150. Flange 150, glazing assembly 16B, glazing stop 56B and frame member 14B, in combination, thus illustrate the relationships of the main elements of window frame 14B with nosing 20 and glazing assembly 16B.

FIG. 6 further shows a side view of a window support 152 which is mounted to the bottom of window frame 14B, or which may, in the alternative, be mounted to a corresponding surface, e.g. top surface, of window frame 14A. A plurality of supports 152, spaced along the side-to-side widths of the windows, space window frames 14A and 14B from each other, e.g. support overlying window frame 14B from window frame 14A. Spacing between the supports 152 is such as to adequately support the weight of the overlying window assembly. Where the joint between the window frames represents other than a horizontal orientation, supports 152 may be better described as spacers, tasked with maintaining a desired spacing between respective window frames. In such case, spacers 152 are spaced along the length of the respective side of the window frame on a given side of glazing 16A.

The items illustrated in FIG. 6 are typically assembled, first, as first and second window frames 14A and 14B, or as first and second window assemblies including glazings. Referring to the illustration in FIG. 6, the top of window frame 14A is that frame element which extends from mounting fingers 54A and 54B. The bottom of window frame 14B is the bottom surfaces of supports 152. Nosing 22 is mounted to window frame 14A as illustrated in FIG. 6. Nosing 20 is mounted to window frame 14B, also as illustrated in FIG. 6.

EXAMPLE 3

Mounting Two Window Frames to Each Other

The two window frames 14A and 14B, with nosings attached, can be assembled to each other as follows. With the lower window frame 14A held stationary, upper window frame 14B is positioned generally as illustrated in FIG. 6, but with upper window frame 14B juxtaposed slightly ahead of lower window frame 14A such that remote upper wall 50 is at opening 144 and remote lower wall 146 is at opening 49. Upper wall 50 is parallel with, and aligned with, opening 144. Lower wall 146 is parallel with, and aligned with, opening 49. Supports 152 are generally positioned at the upper surface of lower window frame 14A.

A pushing force is then engaged at the bottom of upper window frame 14B, such as at nosing 20, pushing rearwardly toward fourth inner end 36 of the outer flange of nosing 22. As the window frame is pushed rearwardly, remote upper wall 50 of nosing 22 becomes engaged in receptacle 142 of nosing 20 and remote lower wall 146 of nosing 20 becomes engaged in receptacle 48 of nosing 22, thus locking nosings 22 and 20 to each other as shown in FIG. 6.

In the assembly process, the upper window frame is moved rearwardly until one of the inserts reaches the inner end of the corresponding receptacle, which serves as a stop, terminating the rearward movement of the upper window frame, whereupon the outer-facing web 138 on nosing 20 is in alignment with outer-facing web 40 on nosing 22, such that the two outer-facing webs form a generally common surface as illustrated.

The spacings and tolerances of the remote upper and lower walls and the respective receptacles are such that the engagements of the remote upper and lower walls of the respective nosings in the receptacles are substantial frictional engagements, such that the nosings tend to remain engaged with each other with modest handling and are not generally released from each other by the action of gravity, even if the temporarily-engaged assembly is re-oriented with limited support for one or more of the window frames. Within the same context, disengagement of the window frames from each other is accomplished with substantial e.g. manually-applied force urging the respective frames in a disengaging direction. Restated, while the nosings are not so loosely engaged as to easily disengage with normal handling, neither do the nosings need to be so forcefully held together that disengagement requires more than the force which can be applied manually by an average adult.

With the nosings so joined, and with the upper window frame located at its desired final juxtaposition relative to the lower window frame, the assembly is being held together at the outwardly-facing surface of the assembly, which will face outwardly of a building to which the assembly will be joined. The upper window is further secured to the lower window at or adjacent the inwardly-facing surface of the assembly by e.g. a corrugated sheet fastener 147, or by nails, or screws, all as discussed with respect to FIG. 5.

While the process of joining and disengaging the nosings has been described in terms of the upper window frame being moved relative to the lower window frame, the joining and disengaging of the nosings can as well be accomplished by holding the upper window frame stationary and moving the lower window frame, or both members can be moved as part of the joining and/or disengaging of the nosings.

Still referring to FIG. 6, the nosing 22 profile is used as the nosing on the lower window frame simply for convenience of using the same extrusion profile as was used in the arcuate nosing assembly 18 at the top of the transom window discussed with respect to FIG. 3, with exception that the nosing 22 in FIG. 6 is not bent into an arcuate configuration. Neither is the nosing in FIG. 6 assembled to an arcuate drip cap 24. Accordingly, the nosing used with the lower window frame need not have certain of the features of the arcuate nosing used at the top of the arcuate transom window frame 14. The features which can be eliminated at will are, without limitation, as follows:

Since the nosing on lower window frame 14A is not bent into an arcuate configuration, the support of intermediate web 44 is not needed, whereby intermediate web 44 becomes optional and can, as desired, be eliminated.

Also because the nosing is not bent into an arcuate configuration in the embodiments illustrated in FIG. 6, the thickness of facia flange 52 can be the same as the thicknesses of the remaining major elements of the nosing, thus about the same thickness as the thicknesses of the inner and outer flanges and/or the inner-facing web and the outer-facing web.

Since the nosing on lower window frame 14A is not joined to an arcuate drip flashing flange, FIG. 6 shows that stud receptacle 46 is not being used and can optionally, as desired, be eliminated so long as the specifications for receptacle 48, 142 and walls 50, 146 provide suitable alignment of outer facing webs 40, 138.

While window frames 14A and 14B have been illustrated as being in overlying, underlying relationship, the same elements and assembly procedures can be used in mounting window frames in a wide variety of collective configurations, thus to mount together multiple window frames/windows in an "X-Y" window matrix having essentially any number of window units in each of the "X" and "Y" directions. Thus, window assemblies can be fabricated in any desired size using a wide variety of assembly configurations, and using a wide variety of window shapes for the designs of the respective windows. Such assemblies can be fabricated in any desired configuration which can subsequently be handled safely for installation.

Any time a straight nosing is being joined to either another straight nosing or a straight drip cap, a flexible sealing compound such as caulk can optionally be spread along the interface before the nosings, or the nosing and the drip cap, are joined to each other. For example and without limitation, in the embodiments of FIG. 5 or FIG. 6, caulk can be applied in receptacle 142 of nosing 20, or on inner flange 124 of nosing 20, or on outer flange 28 of nosing 22, or outer flange 82 of nosing 76.

FIGS. 7(*a*)-7(*p*) illustrate a wide variety of shapes of windows which can be built using the nosings and drip caps, and collective assemblies of such nosings and drip caps. FIGS. 7(*a*)-7(*p*) are illustrative only, and are not exhaustive of the windows designs which can benefit from the nosing structures of the invention.

Any such window having a straight bottom side can be so-mounted to a door header jamb as a transom window. Where the bottom of the window is not straight, the lower edge of the window can be set in an adapter which adapts the lower end of the window to a straight configuration, with the nosing 20 mounted to the lower portion of the adapter.

In the alternative the upper edge of the door frame can be mounted into an adapter which adapts the upper edge of the door frame to the lower edge of the window frame. Either way, the adapter can provide the interface between window and door.

Returning now to the drawings, FIG. 7(*a*) shows a horizontally-elongate rectangular window 158(*a*) which can be used alone, in a cluster, or as a transom window 12 over a door frame. Window 158(*a*), as illustrated, includes an outer frame 14(*a*), and a glazing unit 16(*a*). Window 158(*a*) has four nosing sections which meet at four nosing joints 162(*a*) at respective corners of the window. Window 158(*a*) can be used alone or in clusters, or can be used as a transom window above a door.

A straight drip cap 24 is used with the nosing which extends the top of the window. Drip cap 24 uses e.g. a stud 74 to engage e.g. stud receptacle 46, both of which are illustrated in FIG. 3, thus to fix the inner-to-outer positioning of the drip cap relative to the nosing. Since this nosing/drip cap combination is not bent, any hook/hook receptacle combination does not provide the permanent securement of the nosing and drip cap to each other, although a hook/hook receptacle combination can provide a degree of water resistance by means of the corresponding arduous path the water would have to travel to reach wood substrate.

Since the hook/hook receptacle combination does not secure the drip cap to the nosing like in the arcuate configuration, the drip cap must be otherwise secured to the nosing. In the illustrated embodiment of e.g. FIG. 7(*a*), the drip cap is temporarily positioned at its mounting location over nosing 22. Screw holes are then drilled, at regularly-spaced intervals along the length of the drip cap, through the drip cap and into the nosing outer flange. The drip cap is then removed from the nosing and caulk is applied to the lower surface of the drip cap, at each hole. The drip cap is then re-located to its mounting location on the nosing and the screws are driven through the drip cap and into the nosing, drawing the drip cap into intimate relationship with the nosing. As the drip cap is thus drawn toward the nosing, the movement of the lower surface of the drip cap toward the upper surface of the nosing compresses the caulk whereby the caulk is spread between the lower surface of the drip cap and the upper surface of the outer flange of the nosing, including into and around the screw holes. This spreading of the caulk provides an effective weather seal around the screw holes which, along with the shielding affect of drip flange 70, prevents routine entry of air-borne/weather-borne water into the window frame at the interface of the drip cap and the nosing.

The above description illustrates that the stud and stud receptacle, in the nosing/drip cap combination, serve a positioning function when the stud is seated in the stud receptacle. Namely, the stud will seat in the stud receptacle only when the drip flashing and the nosing are properly aligned with each other. Thus, the stud/stud receptacle combination always provides certainty that the nosing and drip cap are properly aligned with each other. Thus, even where the nosing and drip cap do not need to be bent, the stud/stud receptacle combination provides a desired benefit of certainty of alignment.

In the straight assembly of e.g. FIG. 3, as described earlier herein, the hook and hook receptacle serve as no more than a temporary assembly, which can be readily disengaged. Thus, the need for screws or other fasteners spaced along the length of the drip cap in providing the permanent assembly where the nosing assembly is not arcuate/bent.

Figure 9:
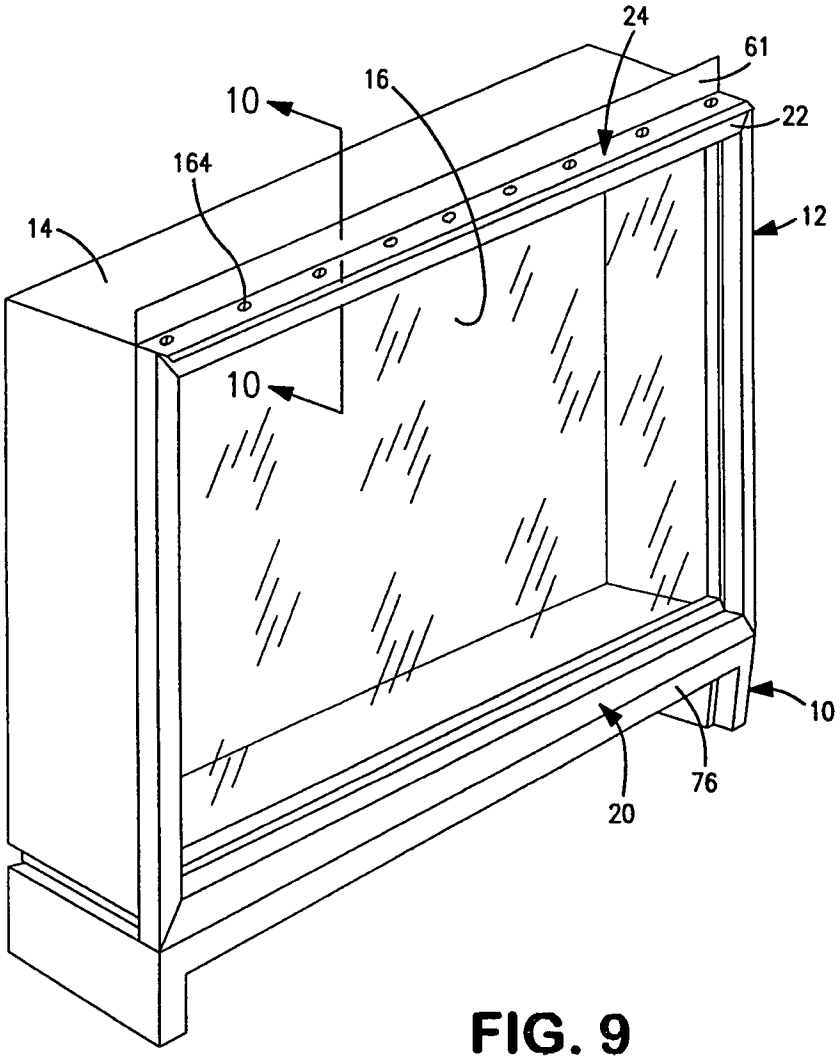
FIG. 9 shows a pictorial view as in FIG. 2, of a rectangular transom window mounted over a door frame.

In other embodiments, illustrated in FIG. 9, the stud-in-stud receptacle combination is used along with regularly-spaced screws 164 holding a straight drip cap to a straight nosing. In such embodiments, the screws hold the upper-to-lower spatial relationship while the stud holds the inner-to-outer relationship whereby the combination of a hook and a hook receptacle is optional.

FIG. 7(*b*) shows a rectangular window 158(*b*), similar to window 158(*a*) of FIG. 7(*a*), except that window 158(*b*) has been re-oriented vertically. Window 158(*b*), as illustrated, includes an outer frame 14(*b*), a glazing unit 16(*b*), and an optional decorative grid 160(*b*). In the vertical/upright orientation, window 158(*b*) can be used alone or in clusters, or can be used as a transom window above a door where the ceiling height at the doorway inside the building so allows. Window 158(*b*) has four nosing sections which meet at four nosing joints 162(*b*) at respective corners of the window. A straight drip cap 24 is assembled to the nosing which extends across the top of the window.

FIG. 7(*c*) shows a trapezoidally-shaped window 158(*c*). Window 158(*c*), as illustrated, includes an outer frame 14(*c*), a glazing unit 16(*c*), and an optional decorative grid 160(*c*). Window 158(*c*) can be used alone, in clusters, or as a transom window over a door. Window 158(*c*) has four nosing sections which meet at four nosing joints 162(*c*) at respective corners of the window. A straight drip cap 24 is assembled to the nosing which extends across the top of the window.

FIG. 7(*d*) shows a parallelogram-shaped window 158(*d*). Window 158(*d*), as illustrated, includes an outer frame 14(*d*), a glazing unit 16(*d*), and an optional decorative grid 160(*d*). Window 158(*d*) can be used alone, in clusters, or as a transom window over a door. Window 158(*d*) has four nosing sections which meet at four nosing joints 162(*d*) at respective corners of the window. A straight drip cap 24 is assembled to the nosing which extends across the top of the window.

FIG. 7(*e*) shows a triangularly-shaped window 158(*e*). Window 158(*e*), as illustrated, includes an outer frame 14(*e*), a glazing unit 16(*e*), and an optional decorative grid 160(*e*). Window 158(*e*) can be used alone, in clusters, or as a transom window over a door. Window 158(*e*) has three nosing sections which meet at three nosing joints 162(*e*) at respective corners of the window. Straight drip caps 24 are assembled to the nosings which extend from the top nosing joint to the lower left and right side nosing joints.

FIG. 7(*f*) shows a half round-shaped window 158(*f*). Window 158(*f*), as illustrated, includes an outer frame 14(*f*), a glazing unit 16(*f*), and an optional decorative grid 160(*f*). Window 158(*f*) can be used alone, in clusters, or as a transom window over a door. Window 158(*f*) has two nosing sections which meet at two nosing joints 162(*f*) at respective corners of the window. An arcuate drip cap 24 is assembled to the nosing which extends, from the two nosing joints along the arcuate top of the window.

FIG. 7(*g*) shows a circle-segment/eyebrow shaped window 158(*g*). Window 158(*g*), as illustrated, includes an outer frame 14(*g*), a glazing unit 16(*g*), and an optional decorative grid 160(*g*). Window 158(*g*) can be used alone, in clusters, or as a transom window over a door. Window 158(*g*) has two nosing sections which meet at two nosing joints 162(*g*) at lower left and right corners of the window. An arcuate drip cap 24 is assembled to the nosing which extends, from the lower left nosing joint, along the arcuate top of the window, to the lower right joint.

FIG. 7(*h*) shows a window known as a springline window 158(*h*). Window 158(*h*), as illustrated, includes an outer frame 14(*h*), a glazing unit 16(*h*), and an optional decorative grid 160(*h*). Window 158(*h*) can be used alone, in clusters, or as a transom window over a door. Window 158(*h*) has two nosing sections which meet at two nosing joints 162(*h*) at respective corners of the window. An arcuate drip cap 24 is assembled to the nosing which extends, from the lower left nosing joint, along the arcuate top of the window, to the lower right joint.

FIG. 7(*i*) shows a window 158(*i*) known as an equal leg arch window 158(*i*). Window 158(*i*), as illustrated, includes an outer frame 14(*i*), a glazing unit 16(*i*), and an optional decorative grid 160(*i*). Window 158(*i*) can be used alone, in clusters, or as a transom window over a door. Window 158(*i*) has four nosing sections which meet at four nosing joints 162(*i*) at respective corners of the window. An arcuate drip cap 24 is assembled to the nosing which extends from the upper left nosing joint, along the arcuate top of the window, to the upper right nosing joint.

FIG. 7(*j*) shows a full round window 158(*j*). Window 158(*j*), as illustrated, includes an outer frame 14(*j*), a glazing unit 16(*j*), and an optional decorative grid 160(*j*). Window 158(*j*) is typically used alone. Window 158(*j*) can have a single nosing section which encircles the entirety of the window. Optionally, window 158(*j*) has two nosing sections, a first such nosing section wrapping the top portion of the window and a second such nosing section wrapping the bottom portion of the window, thus defining first and second nosing joints 162(*j*). Window 158(*j*) is commonly used alone, but may be used in clusters with suitable adaptation framing and/or in combination with other window shapes/designs. Where upper and lower nosings are used, an arcuate drip cap 24 is assembled to the upper nosing.

FIG. 7(*k*) shows a full oval window 158(*k*). Window 158(*k*), as illustrated, includes an outer frame 14(*k*), a glazing unit 16(*k*), and an optional decorative grid 160(*k*). Window 158(*k*) is typically used alone. Window 158(*k*) can have a single nosing section which encircles the entirety of the window. Optionally, window 158(*k*) has two nosing sections, a first such nosing section wrapping the top portion of the window and a second such nosing section wrapping the bottom portion of the window, thus defining first and second nosing joints 162(*j*). Window 158(*j*) is commonly used alone, but may be used in clusters with suitable adaptation framing and/or in combination with other window shapes/designs. Where upper and lower nosings are used, an arcuate drip cap 24 is assembled to the upper nosing.

FIG. 7(*l*) shows an elliptical/oval-shaped window 158(*l*). Window 158(*l*), as illustrated, includes an outer frame 14(*l*), a glazing unit 16(*l*), and an optional decorative grid 160(*l*). Window 158(*l*) can be used alone, in clusters, or as a transom window over a door. Window 158(*l*) has two nosing sections which meet at two nosing joints 162(*l*) at respective corners of the window. An arcuate drip cap 24 is assembled to the nosing which extends, from the lower left joint, across the top of the window, to the lower right joint.

FIG. 7(*m*) shows a gothic-shaped window 158(*m*). Window 158(*m*), as illustrated, includes an outer frame 14(*m*), a glazing unit 16(*m*), and an optional decorative grid 160(*m*). Window 158(*m*) can be used alone, in clusters, or as a transom window over a door. Window 158(*m*) has three nosing sections which meet at three nosing joints 162(*m*) at respective lower left, lower right, and upper, corners of the window. First and second arcuate drip caps 24 are assembled to the nosings which extend, from the upper nosing joint, down the left and right sides of the window.

FIG. 7(*n*) shows a regular octagon window 158(*n*). Window 158(*n*), as illustrated, includes an outer frame 14(*n*), a glazing unit 16(*n*), and an optional decorative grid 160(*n*). Window 158(*n*) is typically used alone, but can be used in clusters or as a transom window over a door. Window 158(*n*) has eight nosing sections which meet at eight nosing joints 162(*n*) at respective corners of the window. First, second, and third straight drip caps 24 are assembled to the nosings which extend along the top and upper left and right sides of the window.

FIG. 7(*o*) shows an elongate octagon window 158(*o*). Window 158(*o*), as illustrated, includes an outer frame 14(*o*), a glazing unit 16(*o*), and an optional decorative grid 160(*o*). Window 158(*o*) is typically used alone, but can be used in clusters or as a transom window over a door. Window 158(*o*) has eight nosing sections which meet at eight nosing joints 162(*o*) at respective corners of the window. First, second, and third straight drip caps 24 are assembled to the nosings which extend along the top and upper left and right sides of the window.

FIG. 7(*p*) shows a quarter-circle-arc window 158(*p*). Window 158(*p*), as illustrated, includes an outer frame 14(*p*), a glazing unit 16(*p*), and an optional decorative grid 160(*p*). Window 158(*p*) is typically used alone, but can be used in combinations or as a transom window over a door. Window 158(*p*) has four nosing sections which meet at four nosing joints 162(*p*) at respective corners of the window. An arcuate drip cap 24 is assembled to the nosing which extends from the upper right nosing joint to the lower left nosing joint.

Figure 8:
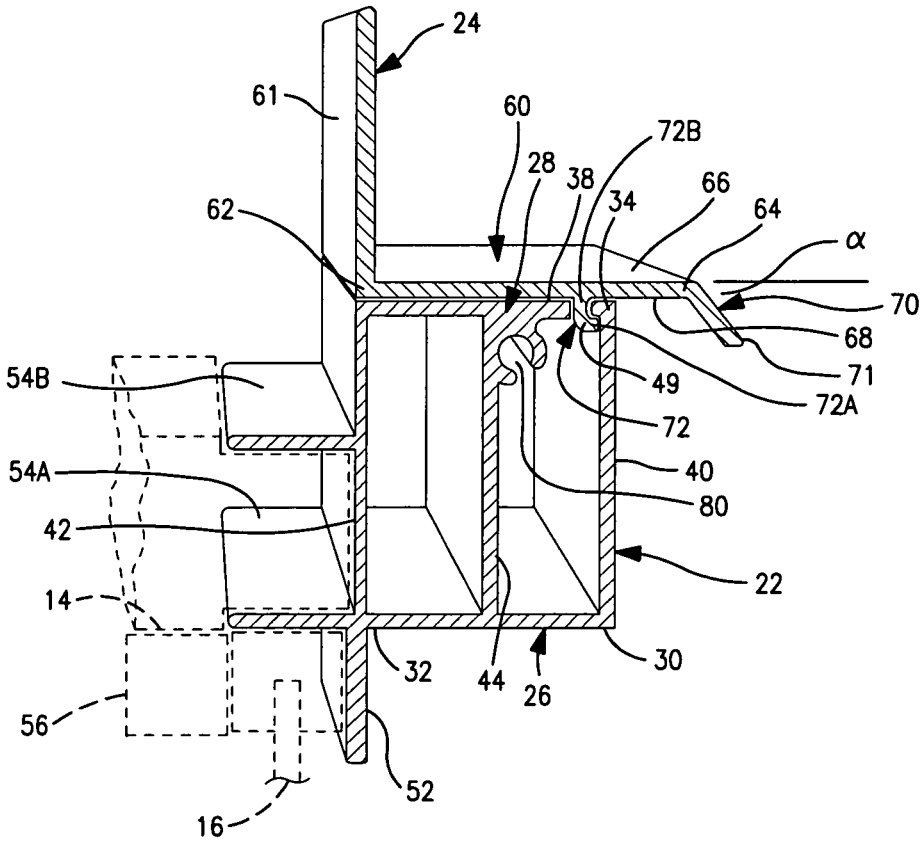
FIG. 8 shows a cross-section of a short length of a straight nosing assembly as in FIG. 3, except without any stud or stud receptacle, and with the hook receptacle opening into the outer flange of the nosing.

As seen in FIGS. 5, 6, and 8, some embodiments of the nosing assembly do not use the stud-in-stud receptacle combination. FIG. 8 illustrates a nosing assembly where both the stud and the stud receptacle have been eliminated. Hook 72 extends downwardly through a hook opening 49 in outer flange 28. Below the outer flange, hook 72 extends toward outer-facing web 40. The horizontally-extending portion 72A of the hook holds the drip cap in vertical fixation relative to the nosing. The downwardly-extending base portion 72B of the hook interfaces with the sidewalls of opening 49 thus to hold the drip cap in horizontal fixation relative to the nosing.

Drip cap 24 is assembled to nosing 22 in FIG. 8 by aligning the drip cap with the nosing, with the inner end 62 of platform 60 raised from outer surface 38 of outer flange 28. With inner end 62 so raised, the leading edge of hook 72 is aligned with opening 49, and is inserted into opening 49. As the hook progresses into opening 49, the curvature on hook 72 urges the lowering of inner end 62. By the time the hook is fully seated in opening 49 as shown in FIG. 8, inner end 62 of the platform is in general surface-to-surface relationship with outer surface 38 of the nosing, allowing for any caulk or other flexible sealing compound between such surfaces. With the drip cap is so assembled to the nosing, the interaction between the base of the hook and the sidewalls of opening 49 control/limit/prevent front-to-rear e.g. horizontal movement of the drip cap relative to the nosing. The e.g. horizontal portion of the hook controls/limits/prevents movement of the front of the drip cap relative to the nosing perpendicular to the outer surface of the nosing, but does not so limit such movement at the rear/inner portion of the drip cap. If such assembly is bent as in the embodiments of FIGS. 1, 2 and 4, the bending provides the restraint to such perpendicular movement. If the assembly is not bent, then other means such as fasteners, as are disclosed hereinafter with respect to FIG. 9, are employed toward the rear of the drip cap, e.g. adjacent inner end 62 of the platform.

FIG. 9 illustrates a straight nosing assembly, including a straight drip cap 24, mounted at the top of a rectangular e.g. transom window. Such straight drip cap can be held in horizontal, front-to-rear position relative to the nosing either by a combination of stud and stud receptacle, or by a hook 72 as illustrated in FIG. 8. Either way, in such straight configuration, screws 164 are spaced along the length of the drip cap, extending through the drip cap and into the nosing, thus providing permanent attachment of the drip cap and nosing to each other.

Figure 10:
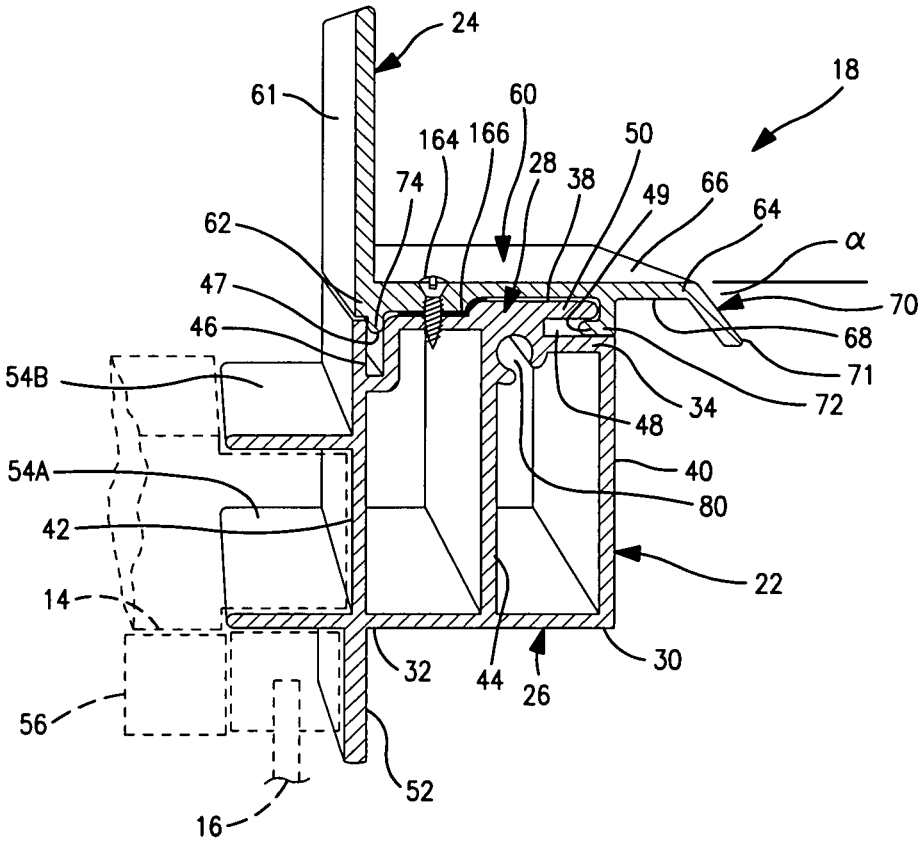
FIG. 10 is a cross-section view, taken at 10-10 in FIG. 9, showing the relationships between the screws, the drip cap, the nosing, and the caulk.

FIG. 10 shows a cross-section of the nosing assembly of FIG. 9, illustrating a screw 164 extending through the drip cap, and outer flange of the nosing. FIG. 10 also illustrates caulk 166 between lower surface 68 of the drip cap platform and outer surface 38 of the nosing outer flange. Caulk 166, where used, can be confined to the areas of the screws, thus to seal around the screws. In the alternative, caulk 166 can extend the full length of the drip cap, as well as being present at the screw holes, thus to provide a continuous barrier between the nosing outer flange and the drip cap lower surface, as well as at the screw holes. Such continuous barrier serves as a back-up barrier, backing up the barrier which is created by the convoluted path about the combination of the hook and the hook receptacle.

Joining frames together has been described herein in terms of joining a clad window frame to a clad door frame as in FIG. 5, and in terms of joining a clad window frame to a clad window frame as in FIG. 6. The same principles can be used, along with selected ones of the nosings, to similarly join a clad door frame to a clad door frame.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. In combination, an elongate nosing and an elongate drip cap, (a) said elongate nosing having a nosing length, and comprising (i) an elongate inner flange having an inner flange length, a first outer end and a second inner end, (ii) an elongate outer flange having an outer surface, an outer flange length, a third outer end, and a fourth inner end, said outer flange being spaced from said inner flange, (iii) an elongate outer-facing web having an outer-facing web length, said outer-facing web connecting to said inner flange and to said outer flange, (iv) an elongate inner-facing web, having an inner-facing web length, said inner-facing web connecting to said inner flange and to said outer flange, (v) as part of said elongate nosing, an elongate front facia flange, said front facia flange extending, from a proximal end thereof at said inner flange, away from said outer flange, and (vi) at least one of (A) a stud receptacle having an opening extending from the outer surface of said outer flange toward said inner flange, and (B) a hook receptacle having an opening and extending from such opening at one of said outer flange, said outer-facing web, and said inner-facing web, into said nosing and toward one of said outer-facing web and said inner-facing web; and (b) said elongate drip cap being adapted to being mounted to said nosing, said drip cap having opposing ends and a drip cap length, and comprising (i) an elongate drip cap platform, having a first inner end and a second outer end, a platform upper surface, and a platform lower surface, and (ii) at least one of a stud and a hook extending downwardly from said platform and being adapted to cooperate with a respective one of said stud receptacle and said hook receptacle in assembling said drip cap and said nosing to each other, and wherein the inner end of said platform is in alignment with the inner-facing web when said drip cap is assembled to said nosing.

2. A combination as in claim 1, said elongate drip cap further comprising an elongate drip flange (70) extending from said platform (60), at the second outer end (64) of said platform, at an obtuse angle to the upper surface of said drip cap platform.

3. In combination, an elongate nosing and an elongate drip cap, (a) said elongate nosing having a nosing length, and comprising (i) an elongate inner flange having an inner flange length, a first outer end and a second inner end, (ii) an elongate outer flange having an outer surface, an outer flange length, a third outer end, and a fourth inner end, said outer flange being spaced from said inner flange, (iii) an elongate outer-facing web having an outer-facing web length, said outer-facing web connecting to said inner flange and to said outer flange, (iv) an elongate inner-facing web, having an inner-facing web length, said inner-facing web connecting to said inner flange and to said outer flange, (v) as part of said elongate nosing, an elongate front facia flange, said front facia flange extending, from a proximal end thereof at said inner flange, away from said outer flange, and (vi) at least one of (A) a stud receptacle having opening extending from the outer surface of said outer flange toward said inner flange, and (B) a hook receptacle having an opening and extending from such opening at one of said outer flange, said outer-facing web, and said inner-facing web, into said nosing and toward one of said outer-facing web and said inner-facing web; and (b) said elongate drip cap being adapted to being mounted to said nosing, said drip cap having opposing ends and a drip cap length, and comprising (i) an elongate drip cap platform, having a first inner end and a second outer end, a platform upper surface, and a platform lower surface, and (ii) at least one of a stud and a hook extending downwardly from said platform and being adapted to cooperate with a respective one of said stud receptacle and said hook receptacle in assembling said drip cap and said nosing to each other, said drip cap comprising a drip cap flange extending from said drip flashing platform and in alignment with said inner-facing web.

4. In combination, an elongate nosing and an elongate drip cap, (a) said elongate nosing having a nosing length, and comprising (i) an elongate inner flange having an inner flange length, a first outer end and a second inner end, (ii) an elongate outer flange having an outer surface, an outer flange length, a third outer end, and a fourth inner end, said outer flange being spaced from said inner flange, (iii) an elongate outer-facing web having an outer-facing web length, said outer-facing web connecting to said inner flange and to said outer flange, (iv) an elongate inner-facing web, having an inner-facing web length, said inner-facing web connecting to said inner flange and to said outer flange, (v) as part of said elongate nosing, an elongate front facia flange, said front facia flange extending, from a proximal end thereof at said inner flange, away from said outer flange, and (vi) at least one of (A) a stud receptacle having an opening extending from the outer surface of said outer flange toward said inner flange, and (B) a hook receptacle having an opening and extending from such opening at one of said outer flange, said outer-facing web, and said inner-facing web, into said nosing and toward one of said outer-facing facing web and said inner-facing web; and (b) said elongate drip cap being adapted to being mounted to said nosing, said drip cap haying opposing ends and a drip cap length, and comprising (i) an elongate drip cap platform, having a first inner end and a second outer end, a platform upper surface, and a platform lower surface, and (ii) at least one of a stud and a hook extending downwardly from said platform and being adapted to cooperate with a respective one of said stud receptacle and said hook receptacle in assembling said drip cap and said nosing to each other, said drip cap platform extending from an inner end thereof and terminating at a first remote edge thereof spaced from said outer flange, said drip cap further comprising a drip flashing flange extending from the inner end of said drip cap, and in alignment with said inner-facing web, to a second remote end, said drip cap platform and said drip flashing flange defining first and second sides of an otherwise open space.

5. An arcuate nosing assembly including the combination as in claim 3 wherein said drip cap and said nosing are assembled to each other with said hook in said hook receptacle, said hook being loosely, slidingly engaged in said hook receptacle upon initial assembly to said nosing, said nosing assembly having been bent about a radius of at least 6 inches, into such arcuate configuration, and wherein said hook and said hook receptacle have been brought into a locking-type engagement with each other by said bending.

6. An arcuate nosing assembly as in claim 5, further comprising, as an element of said nosing, an elongate intermediate web extending between intermediate parts of said inner flange and said outer flange and extending along the length of said inner-facing web.

7. An arcuate nosing assembly as in claim 6, said nosing and said drip cap being extruded aluminum profiles wherein said inner-facing web, said outer-facing web, and said intermediate web have web thicknesses of about 0.05 inch to about 0.09 inch, said nosing assembly having been bent about a radius of at least 12 inches.

8. An arcuate nosing assembly as in claim 5, said hook receptacle comprising an upper wall, said hook and said upper wall of said hook receptacle having been brought into such locking-type engagement with each other as a result of the bending of said nosing assembly.

9. In combination, an elongate nosing and an elongate drip cap, (a) said elongate nosing having a nosing length, and comprising (i) an elongate inner flange having an inner flange length, a first outer end and a second inner end, (ii) an elongate outer flange having an outer surface, an outer flange length, a third outer end, and a fourth inner end, said outer flange being spaced from said inner flange, (iii) an elongate outer-facing web having an outer-facing web length, said outer-facing web connecting to said inner flange and to said outer flange, (iv) an elongate inner-facing web, having an inner-facing web length, said inner-facing web connecting to said inner flange and to said outer flange, (v) an elongate front facia flange, said front facia flange extending away from said outer flange, and being displaced from said outer-facing web, and (vi) at least one of (A) a stud receptacle having an opening extending from the outer surface of said outer flange toward said inner flange, and (B) a hook receptacle having an opening and extending from such opening at one of said outer flange, said outer-facing web, and said inner-facing web, into said nosing and toward one of said outer-facing web and said inner-facing web; and (b) said elongate drip cap being adapted to being mounted to said nosing, said drip cap having opposing ends and a drip cap length, and comprising (i) an elongate drip cap platform, having a first inner side and a second outer side, a platform upper surface, and a platform lower surface, and (ii) at least one of a stud and a hook extending downwardly from said platform and being adapted to cooperate with a respective one of said stud receptacle and said hook receptacle in assembling said drip cap and said nosing to each other, further comprising, as an element of said nosing, an elongate intermediate web extending between intermediate parts of said inner flange and said outer flange and extending along the length of said inner-facing web, at least portions of the lengths of said nosing and said drip cap are arranged in arcuate configurations and wherein said front fade flange is disposed to the inside of the arc in said nosing, and said drip cap is disposed to the outside of the arc of said nosing, wherein each of said outer-facing web, said inner-facing web, and said intermediate web has a web thickness of about 0.05 inch to about 0.09 inch, and wherein said front facia flange has a web thickness greater than the thicknesses, taken individually, of said inner-facing web, said outer-facing web, and said intermediate web, said front facia flange having an average web thickness of about 0.08 inch to about 0.10 inch.

10. A window frame having a straight side and an arcuate side, an arcuate nosing assembly as in claim 5 being mounted to the arcuate side of said window frame.

11. A window frame having at least one arcuate side, said arcuate side comprising an arcuate nosing assembly as in claim 5 said drip cap and said nosing being secured to each other by the locking engagement of said hook and said hook receptacle, said drip cap being devoid of fasteners driven therethrough and into said nosing at locations away from end portions of said drip cap.

12. A window frame as in claim 11, further comprising a fastener extending through said drip cap, and into said nosing, only at each of said end portions.

13. A window comprising a window frame as in claim 11, and a glazing in said window frame.

14. A window frame having at least first, second, and third sides joined to each other in end-to-end relationship, said first side comprising a nosing assembly as in claim 5, arranged in an arcuate configuration, with said front facia flange disposed to the inside of the arc.

15. A window comprising a window frame as in claim 14 and a glazing in said window frame.

16. An arcuate nosing assembly including the combination as in claim 1, said drip cap comprising an integral stud, said drip cap and said nosing being assembled to each other with said stud in said stud receptacle, said stud and said stud receptacle so cooperating with each other as to inhibit movement of said drip cap toward or away from the third end of said outer flange, and a plurality of fasteners spaced along the length of said drip cap, including away from end regions of said drip cap, said plurality of fasteners holding said drip cap and said nosing in fixed longitudinal relationship to each other.

17. A nosing assembly as in claim 16, said fasteners extending through said drip cap and into said nosing through a plurality of mounting holes, and further comprising a flexible sealing compound between said drip cap and said nosing at said holes.

18. A window frame having at least first, second, and third sides joined to each other in end-to-end relationship, at least one of said sides comprising a nosing assembly as in claim 16.

19. A window, comprising a window frame and glazing in said window frame, at least a first side of said window frame comprising a nosing assembly as in claim 16.

20. A nosing assembly, comprising:

(a) an elongate nosing having a nosing length, and comprising (i) inner and outer flanges, an inner-facing web and an outer-facing web collectively connecting said inner and outer flanges to each other, an outer surface being defined on said outer flange, and a front facia flange integral with said inner-facing web, (ii) a hook receptacle on one of said inner-facing web or said outer-facing web or on said outer flange; and (b) an elongate drip cap, said drip cap comprising (i) an elongate drip cap platform, having a platform upper surface and a platform lower surface, a first inner side and a second outer side, (ii) a hook extending downwardly from the platform and toward one of the first inner side and the second outer side, and (iii) a drip flashing flange extending from said drip cap platform and in alignment with said inner-facing web, said drip cap being assembled to said nosing with said hook in said hook receptacle.

21. A nosing assembly as in claim 20, said nosing assembly having been bent about a radius of 18 inches or less, with said front facia flange on the inside of the bend, said hook and said hook receptacle being in locking-type engagement with each other so as to hold said drip cap and said nosing to each other at an interface between the outer surface of said outer flange and the lower platform surface of said drip cap.

22. A nosing assembly as in claim 20 wherein said hook and said hook receptacle cooperate with each other to inhibit movement of said drip cap toward or away from the third end of said outer flange and wherein said hook so engages the hook receptacle at an upper wall thereof as to prevent movement of said drip cap perpendicularly away from said outer flange of said nosing.

23. A window frame having a straight side and an arcuate top side, said arcuate top side comprising a nosing assembly as in claim 21.

24. A window frame as in claim 23, said hook and said hook receptacle having been brought into such locking-type engagement with each other by such bending.

25. A window frame as in claim 24, the interface extending generally between first and second ends of said nosing assembly, further comprising a flexible sealing compound extending along the interface between said nosing and said drip cap, from the first end to the second end.

26. A window assembly comprising a first framed window and a second framed window, said first framed window comprising an arcuate window frame having a straight side and an arcuate top side, said arcuate top side comprising a bent nosing assembly, said bent nosing assembly comprising (a) an elongate nosing having a nosing length, and comprising (i) inner and outer flanges, and a plurality of webs connecting said inner and outer flanges to each other, an outer surface being defined on said outer flange and (ii) a hook receptacle on one of said plurality of webs connecting said inner and outer flanges to each other, or on said outer flange, said hook receptacle being defined, at least in part, by one or more walls, including an upper said wall; and (b) an elongate drip cap, said drip cap comprising (i) an elongate drip cap platform, having a platform upper surface and a platform lower surface, a first inner side and a second outer side, and (ii) a hook extending downwardly from the platform and toward one of the first inner side and the second outer side, said drip cap being assembled to said nosing with said hook in said hook receptacle, said nosing assembly having been bent about a radius, said hook and said hook receptacle being in locking-type engagement with each other so as to hold said drip cap and said nosing to each other at an interface between the outer surface of said outer flange and the lower platform surface of said drip cap, said hook and said hook receptacle having been brought into such locking-type engagement with each other by such bending, said straight side of said first window comprising a first insert and a first insert receptacle, said second framed window comprising a second insert and a second insert receptacle, said first insert being received in said second insert receptacle and said second insert being received in said first insert receptacle, thereby to mount said first and second windows to each other.

27. A door assembly comprising a framed door, and an attached arcuate window frame as in claim 24.

28. A method of making an arcuate nosing assembly for use in a window having an arcuate side, the method comprising:

(a) assembling together an elongate nosing having a first length and an elongate drip cap having a second length, (i) the nosing having inner and outer flanges, and an inner-facing web, an outer-facing web, and an intermediate web collectively connecting the inner and outer flanges to each other, an outer surface being defined on the outer flange, and a hook receptacle being defined on one of the plurality of webs connecting the inner and outer flanges to each other, or on the outer flange, and an elongate front facia flange extending, from a proximal end thereof at the inner flange, away from the outer flange, wherein each of the inner-facing web, the outer-facing web, and the intermediate web has a web thickness, and wherein the front facia flange has a web thickness greater than the thicknesses, taken individually, of any of the inner-facing web, the outer facing web, or the intermediate web, (ii) the drip cap comprising an elongate drip cap platform, and a drip flashing flange extending from the drip cap platform and in alignment with the inner-facing web, the drip cap platform having a platform upper surface and a platform lower surface, a first inner side and a second outer side, and a hook extending downwardly from the platform and toward one of the first inner side and the second outer side, the nosing and the drip cap being assembled to each other at an interface between the nosing and the drip cap, with the hook engaged in the hook receptacle; and (b) bending the assembly of the nosing and the drip cap, with the inner flange and the front facia flange being to the inside of the bend, the bending reforming the combination of the hook and the hook receptacle so as to bring the hook and the hook receptacle into a tightened locking-type engagement with each other, and the front facia flange accommodating material flow resulting from such bending without buckling.

29. In combination, an elongate nosing and an elongate drip cap, (a) said elongate nosing having a nosing length, and comprising (i) an elongate inner flange having an inner flange length, a first outer end and a second inner end, (ii) an elongate outer flange having an outer surface, an outer flange length, a third outer end, and a fourth inner end, said outer flange being spaced from said inner flange, (iii) an elongate outer-facing web having an outer-facing web length, said outer-facing web connecting to said inner flange and to said outer flange, (iv) an elongate inner-facing web, having an inner-facing web length, said inner-facing web connecting to said inner flange and to said outer flange, (v) an elongate front facia flange, said front facia flange extending away from said outer flange, and being displaced from said outer-facing web, and (vi) at least one of (A) a stud receptacle having an opening extending from the outer surface of said outer flange toward said inner flange, and (B) a hook receptacle having an opening and extending from such opening at one of said outer flange, said outer-facing web, and said inner-facing web, into said nosing and toward one of said outer-facing web and said inner-facing web, and (b) said elongate drip cap being adapted to being mounted to said nosing, said drip cap having opposing ends and a drip cap length, and comprising (i) an elongate drip cap platform, having a first inner side and a second outer side, a platform upper surface, and a platform lower surface, (ii) at least one of a stud and a hook extending downwardly from said platform and being adapted to cooperate with a respective one of said stud receptacle and said hook receptacle in assembling said drip cap and said nosing to each other, and (iii) a drip flashing flange extending from said drip cap platform and in alignment with said inner facing web.

30. A window assembly comprising a first framed window and a second framed window, said first framed window comprising a nosing assembly, said nosing assembly comprising (a) an elongate nosing having a nosing length, and comprising (i) inner and outer flanges, and a plurality of webs connecting said inner and outer flanges to each other, an outer surface being defined on said outer flange, and (ii) a hook receptacle on one of said plurality of webs connecting said inner and outer flanges to each other, or on said outer flange, said hook receptacle being defined, at least in part, by one or more walls, including an upper said wall; and (b) an elongate drip cap, said drip cap comprising (i) an elongate drip cap platform, having a platform upper surface and a platform lower surface, a first inner side and a second outer side, and (ii) a hook extending downwardly from the platform and toward one of the first inner side and the second outer side, said drip cap being assembled to said nosing with said hook in said hook receptacle, said hook and said hook receptacle being in locking-type engagement with each other so as to hold said drip cap and said nosing to each other at an interface between the outer surface of said outer flange and the lower platform surface of said drip cap, a straight side of said first window comprising a first insert and a first insert receptacle, said second framed window comprising a second insert and a second insert receptacle, said first insert being received in said second insert receptacle and said second insert being received in said first insert receptacle, thereby to mount said first and second windows to each other.

* * * * *

UNITED STATES PATENT AND TRADEMARK OFFICE

CERTIFICATE OF CORRECTION

PATENT NO. : 8,528,281 B2
APPLICATION NO. : 12/590374
DATED : September 10, 2013
INVENTOR(S) : Gary L. Boldt It is certified that error appears in the above-identified patent and that said Letters Patent is hereby corrected as shown below:

In the Specification:

In column 24, line 47 of the granted patent, remove “is” after “drip cap”.

In the Claims:

In column 27, line 33, Claim 4 of the granted patent, remove “haying” and replace with --having--.

Signed and Sealed this
Twenty-sixth Day of November, 2013

Margaret A. Focarino

Margaret A. Focarino
*Commissioner for Patents of the United States Patent and Trademark Office*